US012227880B2

(12) United States Patent
Wu et al.

(10) Patent No.: US 12,227,880 B2
(45) Date of Patent: Feb. 18, 2025

(54) CENTRIFUGAL SPINNING APPARATUS AND PLANAR RECEIVING-TYPE CENTRIFUGAL SPINNING AUTOMATIC PRODUCTION DEVICE

(71) Applicants: YIMAO ENVIRONMENTAL TECHNOLOGY CO., LTD., Suqian (CN); WUHAN TEXTILE UNIVERSITY, Wuhan (CN)

(72) Inventors: Longtao Wu, Suqian (CN); Weilin Xu, Suqian (CN); Baoxiang Song, Suqian (CN); Xin Liu, Suqian (CN); Yafei Wang, Suqian (CN); Chen Li, Suqian (CN); Taizhao Chen, Suqian (CN); Zihang Wu, Suqian (CN)

(73) Assignees: YIMAO ENVIRONMENTAL TECHNOLOGY CO., LTD., Suqian (CN); WUHAN TEXTILE UNIVERSITY, Wuhan (CN)

( * ) Notice: Subject to any disclaimer, the term of this patent is extended or adjusted under 35 U.S.C. 154(b) by 0 days.

(21) Appl. No.: 17/604,395

(22) PCT Filed: Sep. 19, 2019

(86) PCT No.: PCT/CN2019/106755
§ 371 (c)(1),
(2) Date: Oct. 16, 2021

(87) PCT Pub. No.: WO2020/232928
PCT Pub. Date: Nov. 26, 2020

(65) Prior Publication Data

US 2022/0195629 A1 Jun. 23, 2022

(30) Foreign Application Priority Data

May 22, 2019 (CN) ..... 201910431022.6
May 22, 2019 (CN) ..... 201910431025.X
May 22, 2019 (CN) ..... 201910431532.3

(51) Int. Cl.
*D01D 7/00* (2006.01)
*D01D 5/18* (2006.01)
(Continued)

(52) U.S. Cl.
CPC ..... *D01D 7/00* (2013.01); *D01D 5/18* (2013.01); *D01D 5/24* (2013.01); *D01D 5/253* (2013.01); *D04H 1/724* (2013.01)

(58) Field of Classification Search
CPC ..... D01D 5/18; D01D 5/24; D01D 5/253; D01D 7/00
See application file for complete search history.

(56) References Cited

U.S. PATENT DOCUMENTS 5,277,858 A * 1/1994 Neal ..... D02J 1/229 264/210.8
5,957,402 A * 9/1999 McEathron ..... B65H 54/026 242/413.3
(Continued)

FOREIGN PATENT DOCUMENTS

CN 102131972 A 7/2011
CN 203782285 U 8/2014
(Continued)

OTHER PUBLICATIONS

Machine translation of CN102131972A from Google Patents, 8 pages. (Year: 2024).*

*Primary Examiner* — Emmanuel S Luk
(74) *Attorney, Agent, or Firm* — Cheng-Ju Chiang

(57) ABSTRACT

The present invention discloses a centrifugal spinning apparatus, including a frame, a spinning device, a feeding device for providing a spinning solution to the spinning device, and a collection device for collecting centrifugal spinning fibers ejected by the spinning device. The collection device is
(Continued)

horizontally disposed below the spinning device, to enable the centrifugal spinning fibers ejected by the spinning device to be attached to a surface of the collection device. A planar receiving-type centrifugal spinning automatic production device using the centrifugal spinning apparatus breaks through existing centrifugal spinning based on ring collection and centrifugal spinning technologies based on electrostatic collection, resolves a preparation problem of continuous filament of the centrifugal spinning, and achieves mass production of the centrifugal spinning. The whole production process is completed automatically without manual intervention.

24 Claims, 15 Drawing Sheets

(51) Int. Cl.

| | |
|---|---|
| ***D01D 5/24*** | (2006.01) |
| ***D01D 5/253*** | (2006.01) |
| ***D04H 1/724*** | (2012.01) |

(56) References Cited

U.S. PATENT DOCUMENTS

| | | | | |
|---|---|---|---|---|
| 7,004,738 | B2 * | 2/2006 | Becker | D01D 5/0985 156/441 |
| 8,650,718 | B2 * | 2/2014 | Isik | D01H 5/26 19/248 |
| 9,365,951 | B2 * | 6/2016 | Lamanac | D01D 7/00 |
| 9,394,627 | B2 * | 7/2016 | Peno | D01D 1/04 |
| 10,240,257 | B2 * | 3/2019 | Kay | D01D 5/0076 |
| 2003/0102585 | A1 * | 6/2003 | Poulin | D01F 1/10 428/408 |
| 2005/0054830 | A1 * | 3/2005 | Islam | D01F 4/02 530/353 |
| 2009/0126333 | A1 * | 5/2009 | Green | D01D 5/0069 57/402 |
| 2012/0295021 | A1 * | 11/2012 | Peno | B29C 48/04 118/308 |
| 2013/0221559 | A1 * | 8/2013 | Schafer | D01D 5/096 264/103 |
| 2014/0057011 | A1 * | 2/2014 | Schutt | D04H 3/005 425/405.1 |
| 2015/0211149 | A1 * | 7/2015 | Lamanac | D01D 7/00 425/8 |
| 2016/0001550 | A1 * | 1/2016 | Huang | B41J 3/407 347/17 |
| 2016/0047061 | A1 * | 2/2016 | Huang | D04H 1/736 264/468 |
| 2016/0047062 | A1 * | 2/2016 | Greenawalt | D04H 1/728 264/465 |
| 2016/0263529 | A1 * | 9/2016 | Menozzi | B01D 65/022 |
| 2020/0353415 | A1 * | 11/2020 | Fujita | B01D 61/362 |

FOREIGN PATENT DOCUMENTS

| | | | | |
|---|---|---|---|---|
| CN | 104178830 | A | 12/2014 | |
| CN | 105155000 | A | 12/2015 | |
| CN | 105951194 | A | 9/2016 | |
| CN | 107190421 | A | 9/2017 | |
| CN | 208219024 | U | 12/2018 | |
| CN | 110241469 | A | 9/2019 | |
| JP | H7-189047 | A | 7/1995 | |
| WO | WO-2014123432 | A1 * | 8/2014 | B29B 17/0026 |

* cited by examiner

CENTRIFUGAL SPINNING APPARATUS AND PLANAR RECEIVING-TYPE CENTRIFUGAL SPINNING AUTOMATIC PRODUCTION DEVICE

CROSS REFERENCE TO RELATED APPLICATIONS

This application is a 35 U.S.C. § 371 National Phase conversion of International (PCT) Patent Application No. PCT/CN2019/106755, filed on Sep. 19, 2019, which claims priority of a Chinese Patent Application No. 201910431025.X, filed on May 22, 2019, a Chinese Patent Application No. 201910431532.3, filed on May 22, 2019, and a Chinese Patent Application No. 201910431022.6, filed on May 22, 2019, the entire content of which is incorporated into this application herein by reference. The PCT International Patent Application was filed and published in Chinese.

TECHNICAL FIELD

The present invention relates to the field of textile technologies, and in particular, to a centrifugal spinning apparatus and a planar receiving-type centrifugal spinning automatic production device using the centrifugal spinning apparatus.

BACKGROUND

Centrifugal spinning is a new spinning technique applicable to both solution spinning and melt spinning. In a spinning process of the centrifugal spinning, a spinning solution in a spinneret is ejected from micropores by a centrifugal force generated by the high-speed rotated spinneret and is formed into slender fibers, by which materials that can be prepared include inorganic materials and polymers. In view of a high yield of the centrifugal spinning and advantages of fiber products, the fiber products prepared by the centrifugal spinning is applicable to biomedicine, air filtration, energy and other fields.

Currently, for the centrifugal spinning, a fiber forming mechanism has been thoroughly researched, and a technical problem to be resolved is how to achieve continuous mass production of the centrifugal spinning. First, the feeding and collection manners of the centrifugal spinning are to be improved. A conventional centrifugal spinning feeding system is a semi-continuous feeding system, that is, each time a centrifugal spinning experiment is performed, the spinning solution is fed into the liquid storage cavity of the spinneret by a syringe, and the spinning process is in a discontinuous manner. For the collection manner, the mass production cannot be achieved in the conventional ring collection manner. In addition, centrifugal spinning yield is to be increased. As a new spinning technique, the yield thereof is obviously higher than that of electrostatic spinning. However, compared with the conventional spinning technology, the yield of the centrifugal spinning is still relatively low. Therefore, continuous spinning feeding and collection manners of the centrifugal spinning are directions of industrialization research.

For example, the invention patent with application No. CN201610424908.4 provides a centrifugal spinning preparation method for a titanium dioxide/polypropylene methacrylate ($TiO_2$/PAN) micro/nanofiber membrane, the provided centrifugal spinning apparatus includes a motor, a spinning head, and a collection rod. The spinning head is mounted on a top of a rotation shaft of the motor and is driven by the motor to rotate. The spinning head has a hollow cavity for containing the spinning solution, a top portion of the spinning head is provided with a liquid injection port, a side wall of the spinning head is provided with a spinneret hole in communication with the hollow cavity, and the collection rod is disposed around the spinning head in a circle. During the centrifugal spinning, the spinning head is driven by the motor to rotate, and the spinning solution is ejected from the spinneret hole of the spinning head, and is stretched by moving between the spinneret hole and the collection rod. The solvent volatilizes to form fibers, and a fiber membrane is received from the collection rod. Such a collection manner fixes the yarn between the collection rods, the formed fibers are discontinuous short fibers, the efficiency is low, and continuous production cannot be achieved.

The patent with application No. CN201820388681.7 provides a centrifugal electrostatic spinning device, including a centrifugal spinning nozzle, a receiving device disposed above the multifilament nozzle, a driving mechanism for driving the centrifugal spinning nozzle, and a power supply device for generating an electrostatic field required for forming the spinning solution between the centrifugal spinning nozzle and the receiving device. A plurality of yarn exit holes are provided on the centrifugal spinning nozzle at intervals in a radial direction of the circumference, and the centrifugal spinning nozzle is connected to a spinning solution delivery device. The receiving device of the device is disposed above the centrifugal spinning nozzle and is grounded, and stretches the ejected yarn flow from the centrifugal spinning nozzle under the action of centrifugal force and electric field force. Such an electrostatic manner cannot achieve continuous production, and has excessive energy consumption, low operability and low safety factor.

SUMMARY OF INVENTION

To overcome the shortcomings in the related art, the present invention provides a centrifugal spinning apparatus capable of performing continuous production and a planar receiving-type centrifugal spinning automatic production device using the centrifugal spinning apparatus.

To achieve the foregoing objective, a centrifugal spinning apparatus is provided in the present invention, including a frame, a spinning device, a feeding device for providing a spinning solution to the spinning device, and a collection device for collecting centrifugal spinning fibers ejected by the spinning device, where the collection device is horizontally disposed below the spinning device, to enable the centrifugal spinning fibers ejected by the spinning device to be attached to a surface of the collection device.

As a further improvement of the present invention, a negative pressure is formed on the surface of the collection device, and the negative pressure absorbs the centrifugal spinning fibers attached to the surface of the collection device onto the collection device.

As a further improvement of the present invention, the spinning device includes a spinner device and a transverse device driving the spinner device to reciprocate horizontally in a direction perpendicular to an extending direction of the collection device.

As a further improvement of the present invention, the spinner device includes a buffer tank connected to the feeding device, a spinneret ejecting the centrifugal spinning fibers, and a feeding pipe communicated with the buffer tank and the spinneret, where an end of the feeding pipe extends into the buffer tank, and another end extends into the spinneret, to guide a spinning solution from the buffer tank to the spinneret.

As a further improvement of the present invention, at least one spinning nozzle is disposed on the spinneret, a cross section of the spinning nozzle is triangular or step-shaped, and the spinning solution in the spinneret is ejected through the spinning nozzle.

As a further improvement of the present invention, the spinner device further includes a hollow shaft sleeved around a periphery of the feeding pipe, and the feeding pipe is not in contact with an inner wall of the hollow shaft.

As a further improvement of the present invention, the spinneret is fixedly mounted at a lower end of the hollow shaft.

As a further improvement of the present invention, the spinner device further includes a power portion driving the spinneret to rotate, where the power portion includes a first motor having an output shaft, a driving pulley connected to the output shaft, a driven pulley connected to the hollow shaft, and a timing belt in transmission connection with the driving pulley and the driven pulley, to enable the first motor to drive the driving pulley to drive the driven pulley to rotate, thereby driving the spinneret connected to the hollow shaft to rotate.

As a further improvement of the present invention, the transverse device includes a fixed support connected to the frame, a transversely movable unit mounted on the fixed support, a slider mounted on the transversely movable unit, a mounting plate connected to the slider, and a transverse strut connected to the mounting plate, the transversely movable unit driving the transverse strut to reciprocate in an extending direction of the transversely movable unit by the slider.

As a further improvement of the present invention, an extending direction of the transverse strut and the extending direction of the transversely movable unit are perpendicular to each other, and two spinner devices are symmetrically mounted at two ends of the transverse strut.

As a further improvement of the present invention, the spinner device further includes a height adjustment device for adjusting a distance between the spinneret and the collection device.

As a further improvement of the present invention, the height adjustment device includes a support plate for fixedly mounting the spinneret, a guide rod connected to the support plate, a substrate mounted on the transverse strut, an adjusting plate connected to an other end of the guide rod, and an adjusting screw rod mounted on the adjusting plate by a bearing seat, where a nut is disposed on the adjusting plate, the adjusting plate is disposed above the substrate, and the adjusting screw rod and the nut are engaged to adjust a distance between the adjusting plate and the substrate, to adjust a distance between the support plate and the collection device.

As a further improvement of the present invention, the height adjustment device further includes a linear bearing fixedly mounted on the substrate, the linear bearing being sleeved around a periphery of the guide rod.

As a further improvement of the present invention, a hand wheel is disposed at an upper end of the adjusting screw rod.

As a further improvement of the present invention, the feeding device includes a storage tank containing the spinning solution inside and a flow pump in communication with the storage tank, the flow pump being connected to a plurality of the buffer tanks through pipelines.

As a further improvement of the present invention, an electric switch valve and a flow meter are disposed on the pipeline between the flow pump and the buffer tank.

As a further improvement of the present invention, a liquid-level meter is disposed in both the storage tank and the buffer tank.

As a further improvement of the present invention, a stirrer is mounted in the storage tank.

As a further improvement of the present invention, the collection device includes a transmission traction device, a collection belt, and a horizontal support plate disposed below the collection belt and configured to support the collection belt, where the collection belt is an annular belt, and the transmission traction device drives the collection belt to perform a circular movement.

As a further improvement of the present invention, the collection belt is provided with a plurality of ventilation holes, and the horizontal support plate is provided with a plurality of through holes.

As a further improvement of the present invention, the collection device further includes an air draft device disposed below the horizontal support plate and configured to form a negative pressure on a surface of the collection belt, to absorb the centrifugal spinning fibers onto the collection belt.

As a further improvement of the present invention, the planar receiving-type centrifugal spinning automatic production device further includes an isolation cover plate annularly disposed around a periphery of the spinning device, the isolation cover plate and the collection belt forming a semi-closed cavity for accommodating the spinning device; and a temperature control device for controlling the temperature of the semi-closed cavity is disposed in the semi-closed cavity.

As a further improvement of the present invention, the temperature control device includes a plurality of electric heating pipes and a plurality of refrigeration devices.

As a further improvement of the present invention, the planar receiving-type centrifugal spinning automatic production device further includes a control system, the control system being in signal connection to the spinning device, the feeding device, and the collection device.

To achieve the foregoing objective, a plane receiving-type automatic centrifugal spinning production apparatus is further provided in the present invention, including a centrifugal spinning apparatus for preparing a centrifugal spinning fiber web, a winding device for winding the centrifugal spinning fiber web into a roll, and a compaction device disposed between the centrifugal spinning apparatus and the winding device and configured to compact the centrifugal spinning fiber web, the centrifugal spinning apparatus being the plane receiving-type centrifugal spinning apparatus according to any one of the foregoing technical solutions.

As a further improvement of the present invention, the compaction device includes a compaction frame, a press roller mounted on the compaction frame, a rotation roller, and a press roller mounting plate for fixedly mounting the press roller; sliders are disposed at two ends of the press roller mounting plate, and slide rails for the sliders to slide are disposed on the compaction frame; and the compaction device further includes an air cylinder disposed above the press roller mounting plate, a floating joint is mounted on a piston rod of the air cylinder, and an end of the floating joint abuts against the press roller mounting plate, to drive the press roller to slide along the slide rail through stretch-out and draw-back of the piston rod.

As a further improvement of the present invention, the compaction device further includes a driving portion for driving the rotation roller to rotate, where the driving portion includes a driving motor having an output shaft, a compaction driving sprocket mounted on the output shaft, a compaction driven sprocket mounted on the output shaft, and a compaction chain in transmission connection with the compaction driving sprocket and the compaction driven sprocket, the driving motor driving the compaction driving sprocket to drive the compaction driven sprocket to rotate, to drive the rotation roller to rotate.

As a further improvement of the present invention, the winding device includes an upper winding frame, and a first guide roller, a limit roller, a tension adjusting roller, a second guide roller, and a winding roller that are sequentially disposed on the upper winding frame in a movement direction of the centrifugal spinning fiber web, the centrifugal spinning fiber web being guided into the winding device by the first guide roller and being wound on the winding roller after being guided by the tension adjusting roller and the second guide roller.

As a further improvement of the present invention, guide blocks are disposed at two sides of the upper winding frame, where the guide blocks are provided with grooves for accommodating end portions of the tension adjusting roller, the tension adjusting roller is pressed on the centrifugal spinning fiber web, and adjusts a tension force of the centrifugal spinning fiber web by sliding in the groove.

As a further improvement of the present invention, the winding device further includes a deviation correcting device, where the deviation correcting device includes a lower winding frame, a linear servo motor, a connecting seat connecting an output shaft of the linear servo motor and the upper winding frame, a deviation correcting slide rail mounted on the lower winding frame, and a deviation correcting slider mounted on the upper winding frame, the linear servo motor adjusting a position of the upper winding frame by driving the deviation correcting slider to slide along the deviation correcting slide rail.

As a further improvement of the present invention, the plane receiving-type automatic centrifugal spinning production apparatus further includes an unwinding device having a base fabric, the base fabric being threaded from the unwinding device into the centrifugal spinning apparatus, being tiled on the collection belt, and an end portion thereof being wound on the winding roller of the winding device.

As a further improvement of the present invention, the unwinding device includes an unwinding frame, and an unwinding roller, a second guide roller, a third guide roller, and a first guide roller that are sequentially mounted on the unwinding frame in a movement direction of the base fabric.

As a further improvement of the present invention, the unwinding roller is an inflatable shaft.

Beneficial effects of the present invention are as follows:

1) The planar receiving-type centrifugal spinning automatic production device of the present invention arranges a continuously-moving collection belt below the spinneret, after an appropriate height is adjusted, the spinning solution ejected by the spinneret during high-speed rotation is formed into fibers instantly, the fibers descend in a spiral line and are collected on the collection belt, and finally form a continuous centrifugal spinning fiber web.
2) In the present invention, the transverse device drives the spinner device to reciprocate horizontally above the collection belt in a direction perpendicular to an extending direction of the collection belt, to enable the yarn ejected by the spinneret to cover the entire collection belt, achieving wide nonwovens production.
3) In the present invention, the deviation correcting device is added to the unwinding device and the winding device, to achieve automatic deviation correction in the production process.

In conclusion, the present invention breaks through existing centrifugal spinning based on ring collection and centrifugal spinning technologies based on electrostatic collection, resolves a preparation problem of continuous filament of the centrifugal spinning, and achieves mass production of the centrifugal spinning, applicable to the compositionality of nanofibers or submicron fibers on the surface of wide nonwovens or the production of the nonwovens with nano or submicron in a wide size. The whole production process is completed automatically without manual intervention.

REFERENCE NUMERALS

Figure 1:
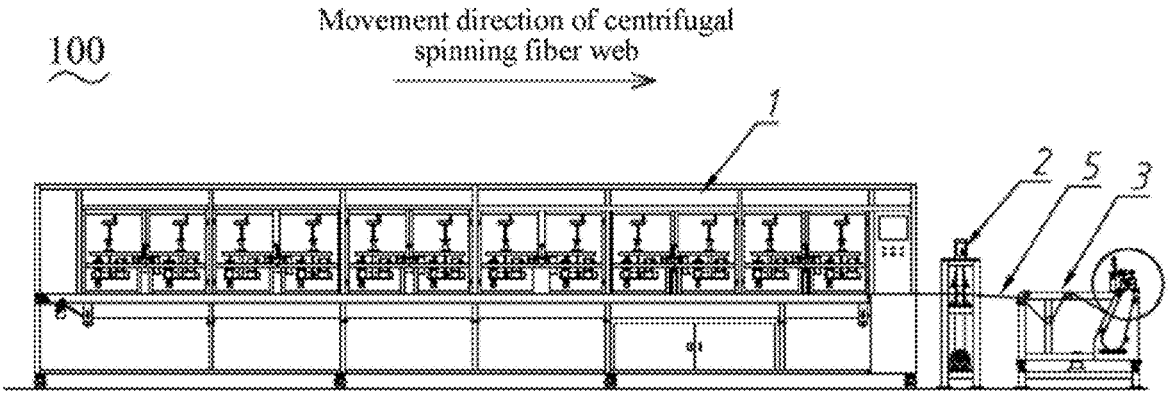
FIG. 1 is a schematic structural diagram of a planar receiving-type centrifugal spinning automatic production device according to Embodiment 1 of the present invention.

1—centrifugal spinning apparatus; 2—compaction device; 3—winding device; 4—unwinding device; 5—centrifugal spinning fiber web; 6—base fabric; 11—frame; 12—feeding device; 13—spinning device; 14—collection device; 15—temperature control device; 16—control system; 132—transverse device; 133—spinner device; 1321—fixed support; 1322—transversely movable unit; 1324—transverse strut; 1337—first motor; 1338—driving pulley; 1339—driven pulley; 1340—spinneret; 1341—tempered glass plate; 1342—storage body; 1343—end cover; 1344—feeding pipe; 1345—hollow shaft; 1346—timing belt; 1348—through hole; 1351—buffer tank support; 1352—linear motor support; 1353—support plate; 1332—adjusting screw rod; 1350—nut; 1333—adjusting plate; 1334—guide rod; 1335—linear bearing; 1336—substrate; 121—storage tank; 123—flow pump; 124—electric switch valve; 122—liquid-level meter; 125—flow meter; 126—stirrer; 141—transmission traction device; 142—collection belt; 143—horizontal support plate; 151—electric heating pipe; 152—refrigeration device; 201—compaction frame; 202—air cylinder; 211—press roller mounting plate; 210—press roller; 207—rotation roller; 213—slide rail; 206—driving motor; 205—compaction driving sprocket; 204—compaction chain; 203—compaction driven sprocket; 306—upper winding frame; 303—first guide roller; 302—limit roller; 305—tension adjusting roller; 301—second guide roller; 319—winding roller; 304—guide block; 317—clamping mechanism; 312—winding motor; 314—winding driving sprocket; 315—winding chain; 316—winding driven sprocket; 321—winding driven shaft; 322—deviation correcting device; 313—lower winding frame; 311—deviation correcting slide rail; 307—deviation correcting slider; 309—linear servo motor; 310—motor fixing base; 308—connecting seat; 401—unwinding roller; 402—unwinding frame; 403—third guide roller; and 1354—spinning nozzle.

DESCRIPTION OF EMBODIMENTS

The following describes preferred embodiments of the present invention in detail with reference to the accompanying drawings, so that the advantages and features of the present invention can be more easily understood by a person skilled in the art, thereby defining the protection scope of the present invention more clearly and explicitly.

The technical solutions in the embodiments of the present invention are clearly and completely described below with reference to the accompanying drawings. Apparently, the described embodiments are merely some of rather than all of the embodiments of the present invention. All other embodiments obtained by a person of ordinary skill in the art based on the embodiments of the present invention without creative effects shall fall within the protection scope of the present invention.

The present invention is further described in detail below by using specific embodiments with reference to the accompanying drawings.

Embodiment 1

Referring to FIG. 1 to FIG. 11, the present invention provides a planar receiving-type centrifugal spinning automatic production device 100 for automatically producing a centrifugal spinning fiber web 5. The planar receiving-type centrifugal spinning automatic production device 100 includes a centrifugal spinning apparatus 1 for preparing the centrifugal spinning fiber web 5, a winding device 3 for winding the centrifugal spinning fiber web 5 into a roll, and a compaction device 2 disposed between the centrifugal spinning apparatus 1 and the winding device 3 and configured to compact the centrifugal spinning fiber web 5. In this implementation, the centrifugal spinning apparatus 1, the compaction device 2, and the winding device 3 are sequentially arranged from front to back according to a movement direction of the centrifugal spinning fiber web 5. After the centrifugal spinning apparatus 1 spins the centrifugal spinning fiber web 5, the centrifugal spinning fiber web 5 is compacted by the compaction device 2 and then guided into the winding device 3, and the winding device 3 winds the centrifugal spinning fiber web 5 into a roll.

Referring to FIG. 2 to FIG. 5 in combination with FIG. 1, the centrifugal spinning apparatus 1 includes a frame 11, a spinning device 13, a feeding device 12 for providing a spinning solution to the spinning device 13, a collection device 14 for collecting centrifugal spinning fibers ejected by the spinning device 13, and a temperature control device 15. The collection device 14 is disposed below the spinning device 13, to enable the centrifugal spinning fibers ejected by the spinning device 13 to be attached to a surface of the collection device 14, thereby achieving plane receiving of centrifugal spinning fibers.

Figure 3:
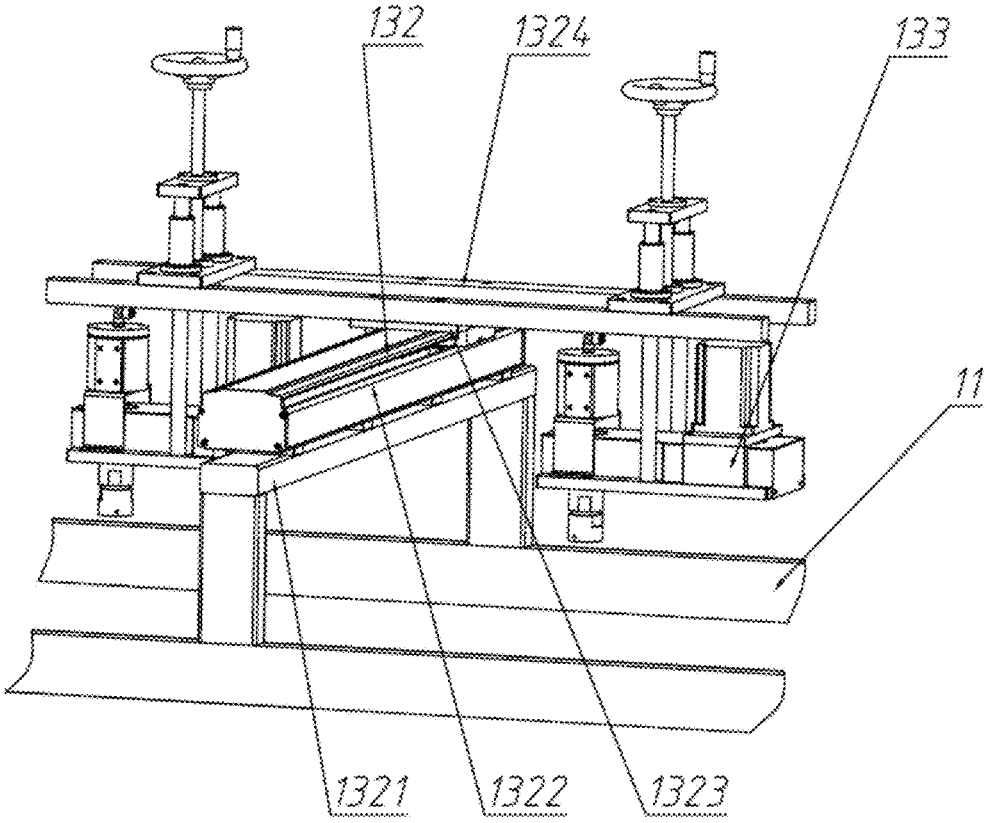
FIG. 3 is a schematic structural diagram of a spinning apparatus in FIG. 2.
Figure 4:
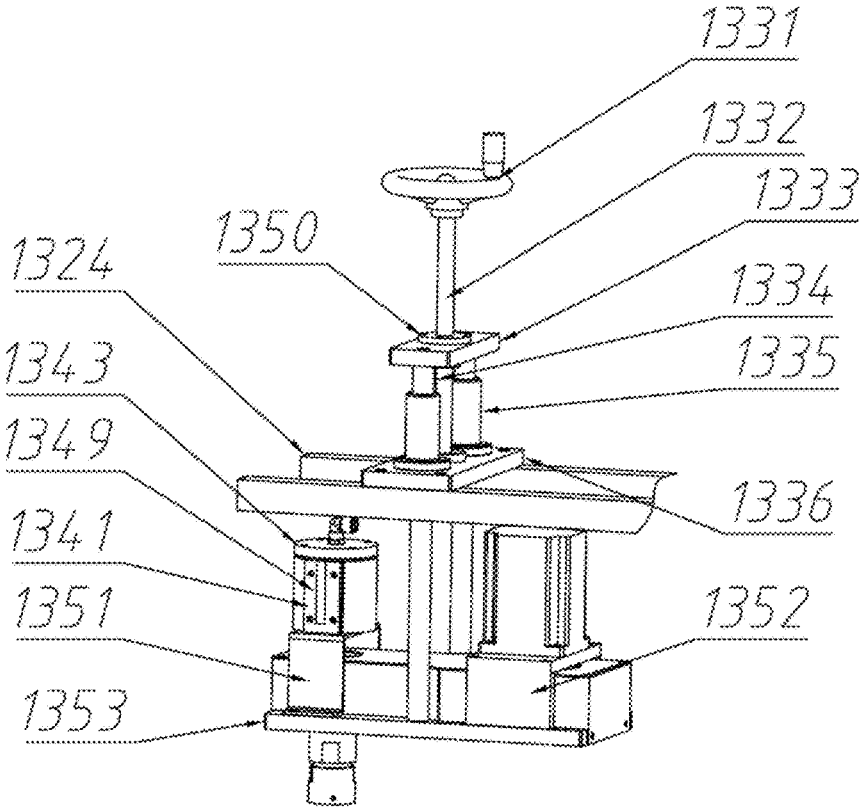
FIG. 4 is a schematic structural diagram of a spinner apparatus in FIG. 3.
Figure 5:
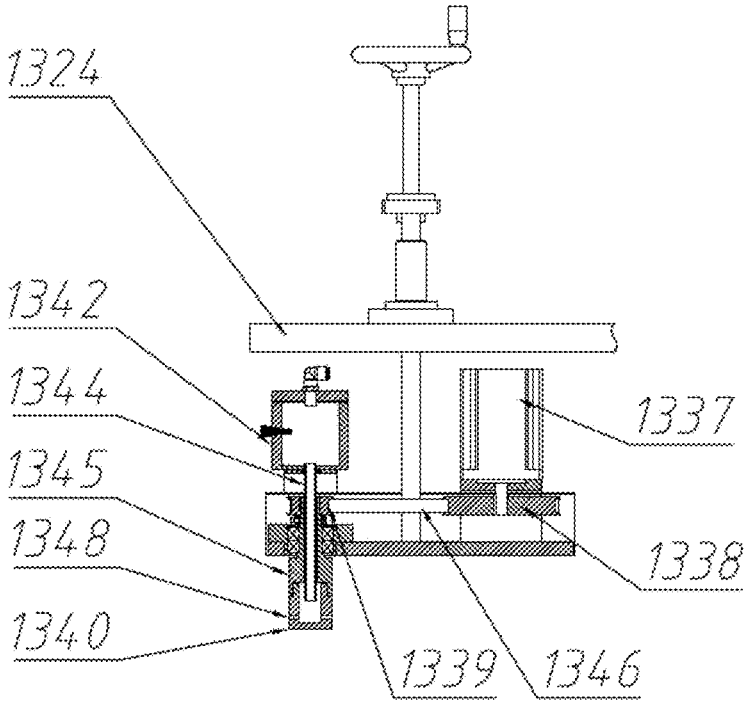
FIG. 5 is a cross-sectional view of the spinner apparatus shown in FIG. 4.

Referring to FIG. 3 to FIG. 5, the spinning device 13 includes a spinner device 133 and a transverse device 132 driving the spinner device 133 to reciprocate horizontally in a direction perpendicular to an extending direction (that is the movement direction of the centrifugal spinning fiber web 5) of the collection device 14, so that the centrifugal spinning fibers ejected by the spinner device 133 uniformly cover the entire collection device 14 in a width direction of the collection device 14. In this way, wide nonwovens production is achieved.

The transverse device 132 is fixedly mounted on the frame 11. The transverse device 132 includes a fixed support 1321 connected to the frame 11, a transversely movable unit 1322 mounted on the fixed support 1321, a slider (not numbered) mounted on the transversely movable unit 1322, a mounting plate 1323 connected to the slider, and two transverse struts 1324 mounted on the mounting plate 1323. With such disposition, the transversely movable unit 1322 drives the transverse strut 1324 to move horizontally by the mounting plate 1323.

In this implementation, two spinner devices 133 are symmetrically mounted at two ends of the two transverse struts 1324. It should be noted that, the quantity of the spinner devices 133 can be set according to a thickness requirement of the centrifugal spinning fiber web 5, which is not specifically limited herein.

The spinner device 133 includes a buffer tank connected to the feeding device 12, a spinneret 1340 ejecting the centrifugal spinning fibers, a feeding pipe 1344 communicated with the buffer tank and the spinneret 1340, a hollow shaft 1345 sleeved around a periphery of the feeding pipe 1344, and a power portion driving the spinneret 1340 to rotate. An end of the feeding pipe 1344 extends into the buffer tank, and another end extends into the spinneret 1340, to guide a spinning solution from the buffer tank to the spinneret 1340, and the feeding pipe 1344 is not in contact with an inner wall of the hollow shaft 1345, thereby avoiding a device failure caused by friction in a working process, and ensuring a normal operation of the device.

The buffer tank includes a storage body 1342, an end cover 1343, and a sealing ring connecting both the storage body 1342 and the end cover 1343 in a sealed manner, to prevent leakage of the spinning solution. For example, the sealing ring may be a corrosion-resistant rubber gasket. A joint connected to the feeding device 12 is mounted on the end cover 1343, and the feeding device 12 pumps the spinning solution into the buffer tank through the joint. Specifically, a transparent tempered glass plate 1341 is disposed on a side wall of the storage body 1342, to help an operator observe a remaining level of the spinning solution in the buffer tank in real time.

An upper end of the feeding pipe 1344 is fixed in the buffer tank by a thread connection, and a fixed junction is sealed by adding the corrosion-resistant rubber gasket. Certainly, a connection manner of the feeding pipe 1344 and the buffer tank is not limited thereto, and merely sealed communication between the feeding pipe 1344 and the buffer tank needs to be ensured.

The power portion includes a first motor 1337 having an output shaft, a driving pulley 1338, a driven pulley 1339, and a timing belt 1346. The driving pulley 1338 is fixedly mounted on the output shaft of the first motor 1337 in a keyed connection, the driven pulley 1339 is fixedly mounted on the hollow shaft 1345 in the keyed connection, and the timing belt 1346 is sleeved on the driving pulley 1338 and the driven pulley 1339. Because the spinneret 1340 is fixedly mounted at a lower end of the hollow shaft 1345, when the first motor 1337 drives the driving pulley 1338 to rotate, the driving pulley 1338 drives, through the timing belt 1346 and the driven pulley 1339, the hollow shaft 1345 to rotate, thereby driving the spinneret 1340 to rotate.

At least one through hole 1348 is processed on the spinneret 1340, and the spinning solution can be ejected from the through hole 1348 during high-speed rotation of the spinneret 1340.

To adjust a height of the spinneret 1340 to ensure a reasonable distance between the spinneret 1340 and the collection device 14, the spinner device 133 further includes a height adjustment device for adjusting the distance between the spinneret 1340 and the collection device 14.

The height adjustment device includes a support plate 1353 for fixedly mounting the spinneret 1340, a guide rod 1334 connected to the support plate 1353, a linear bearing 1335 sleeved around a periphery of the guide rod 1334, a substrate 1336 mounted on the transverse strut 1324, an adjusting plate 1333 connected to an other end of the guide rod 1334, and an adjusting screw rod 1332 mounted on the adjusting plate 1333 by a bearing seat. The linear bearing 1335 is fixedly mounted on the substrate 1336. A nut 1350 is disposed on the adjusting plate 1333, the adjusting plate 1333 is disposed above the substrate 1336, and the adjusting screw rod 1332 and the nut 1350 are engaged to adjust a distance between the support plate 1353 and the collection device 14.

In this implementation, two linear bearings 1335 are disposed, and correspondingly, two guide rods 1334 are disposed. The two guide rods 1334 are respectively sleeved in the two linear bearings 1335. Preferably, a hand wheel 1331 is fixedly mounted on an upper end of the adjusting screw rod 1332. With such disposition, the hand wheel 1331 is manually rotated, the adjusting screw rod 1332 is driven to rotate in the nut 1350, and a distance between the adjusting plate 1333 and the substrate 1336 is adjusted, so that a distance between the transverse strut 1324 and the support plate 1353 is adjusted. The transverse strut 1324 is stationary, and therefore the distance between the spinneret 1340 on the support plate 1353 and the collection device 14 is further changed.

The spinner device 133 further includes a buffer tank support 1351 for fixing the buffer tank and a linear motor support 1352 for fixing the first motor 1337, and both the buffer tank support 1351 and the linear motor support 1352 are fixed on the support plate 1353.

That is, the spinning solution is ejected from the through hole 1348 on the spinneret 1340 during high-speed rotation of the spinneret 1340. Under the combined action of the air resistance, the viscous force of the fluid, and an inertial force of the fluid, and under the action of a pair of axial stresses formed in an axial direction of a jet, the diffusive jet is formed in a fan-shaped area, and a radius of yarns gradually increases at this time. Next, an airflow field caused by the high-speed rotation of the spinneret 1340 starts to guide the jet to draw and stretch, and under the action of gravity, a jet trajectory gradually deflects downward, and the spinning radius gradually decreases. After a process of forming, stretching, and compressing of the jet, fibers finally formed descend in a spiral line and are collected on the collection device 14, and finally form a uniform centrifugal spinning fiber web 5.

Figure 2:
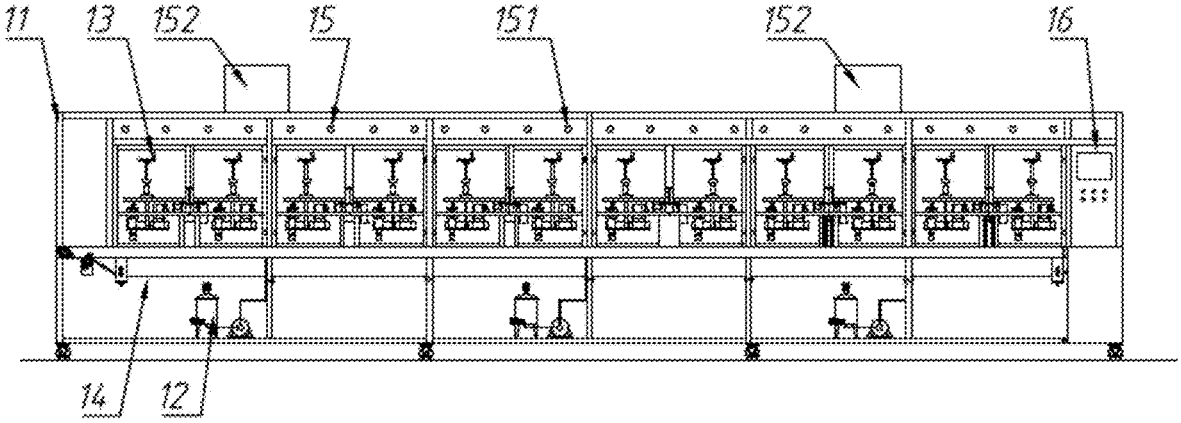
FIG. 2 is a schematic structural diagram of a centrifugal spinning apparatus in FIG. 1.
Figure 6:
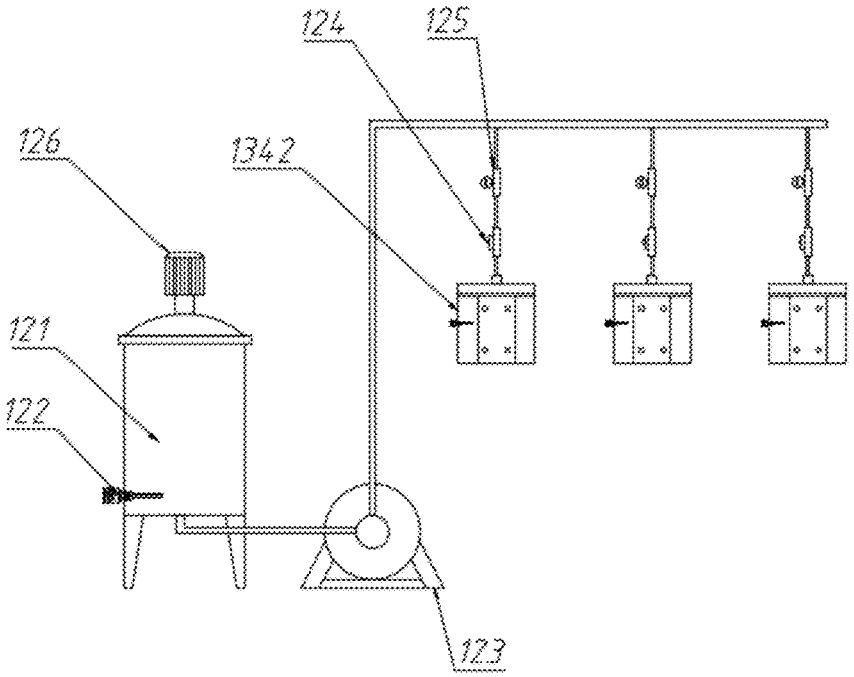
FIG. 6 is a schematic structural diagram of a feeding apparatus in FIG. 2.

Referring to FIG. 6 in combination with FIG. 1 and FIG. 2, the feeding device 12 is fixedly mounted at a bottom of the frame 11. The feeding device 12 includes a storage tank 121 containing the spinning solution and a flow pump 123 in communication with the storage tank 121 through pipelines. The flow pump 123 is connected to a plurality of buffer tanks through pipelines, and feeds the plurality of buffer tanks simultaneously. The flow pump 123 pumps the spinning solution in the storage tank 121 into the plurality of buffer tanks.

Particularly, an electric switch valve 124 is disposed on the pipeline between the flow pump 123 and the buffer tank. The flow pump 123 is in a working state all the time, and the electric switch valve 124 is switched to control whether the spinning solution enters the buffer tank.

A liquid-level meter 122 is disposed in the storage tank 121. When a level of the spinning solution in the storage tank 121 is lower than the liquid-level meter 122, the liquid-level meter 122 sends a signal to a control system 16, the control system 16 issues an alarm to an operator, and the operator makes supplement to the storage tank 121.

The liquid-level meter 122 is alternatively disposed in the buffer tank. When a level of the spinning solution in one of the plurality of buffer tanks is lower than a height of the liquid-level meter 122, the liquid-level meter 122 in the buffer tank sends the signal to the control system 16, the control system 16 controls the electric switch valve 124 corresponding to the buffer tank to be turned on, and the spinning solution in the pipeline enters the buffer tank.

A flow meter 125 is alternatively disposed on the pipeline between the flow pump 123 and the buffer tank. When the electric switch valve 124 is turned on to feed the buffer tank, the flow meter 125 detects a flow of the spinning solution entering the buffer tank. When a set value is reached, the flow meter 125 sends a signal to the control system 16, and the control system 16 controls the electric switch valve 124 to be turned off to stop feeding the buffer tank.

A stirrer 126 is mounted in the storage tank 121. The stirrer 126 stirs the spinning solution in the storage tank 121 while the buffer tank is fed.

Figure 7:
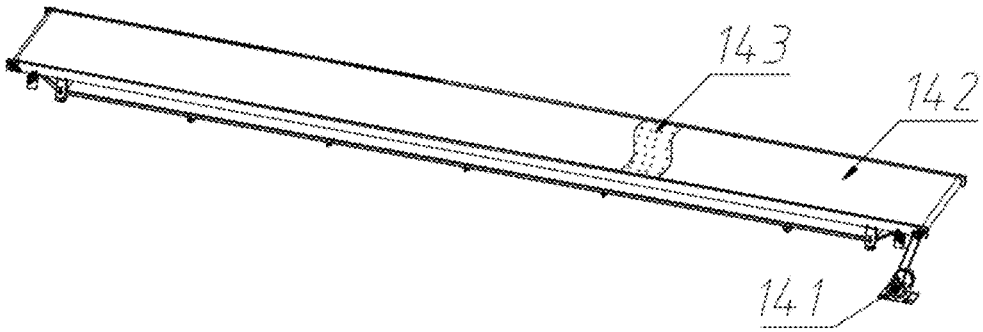
FIG. 7 is a schematic structural diagram of a collection apparatus in FIG. 2.

Referring to FIG. 7, the collection device 14 includes a transmission traction device 141 mounted on the frame 11, a collection belt 142, and a horizontal support plate 143 disposed below the collection belt 142 and configured to support the collection belt 142. The horizontal support plate 143 is configured to ensure that the collection belt 142 is in a horizontal state, so that a fiber web formed by the spinning solution can be conveniently collected. The collection belt 142 is an annular belt sleeved on the transmission traction device 141, and the transmission traction device 141 drives the collection belt 142 to perform a circular movement in a fixed direction.

In this way, the spinning solution in the spinneret 1340 is ejected during high-speed rotation of the spinneret 1340, due to the action of centrifugal force and gravity, the spinning solution is formed into fibers instantly at the moment of ejection, and the fibers are attached to the collection belt 142 to form the fiber web. As the collection belt 142 moves forward, the fiber web is tiled on the collection belt 142 uniformly.

A material of the collection belt 142 is polytetrafluoroethylene, preventing the collection belt 142 from being corroded by the spinning solution.

Preferably, the collection device 14 further includes an air draft device (not shown) disposed below the horizontal support plate 143. At the same time, the collection belt 142 is made into a mesh structure, and dense through holes are processed on the horizontal support plate 143. With such disposition, a negative pressure can be formed on a surface of the collection belt 142, and the negative pressure absorbs the centrifugal spinning fiber web 5 attached to the surface of the collection belt 142 onto the collection belt 142, so that a case that, due to the relatively light fiber web formed by ejection of the spinning solution, the fiber web is blown up by air and falls off from the collection belt 142 during movement of the collection belt 142 can be avoided, thereby improving the production efficiency.

A moving speed of the collection belt 142 is 0 to 10 m/min. According to experimental measurements, when a distance between the spinneret 1340 and the collection belt 142 is between 0 to 100 mm, the spinning effect is the best.

The plane receiving-type centrifugal spinning apparatus 1 further includes an isolation cover plate (not shown) annularly disposed around a periphery of the spinning device 13. A semi-closed cavity for accommodating the spinning device 13 is formed by the isolation cover plate and the collection belt 142, and a temperature control device 15 for controlling the temperature of the semi-closed cavity is disposed in the semi-closed cavity.

The temperature control device 15 is fixedly mounted on an upper portion of the frame 11 and includes a plurality of electric heating pipes 151 and a plurality of refrigeration devices 152. The plurality of electric heating pipes 151 are uniformly distributed above the spinning device 13, and heat the air in the semi-closed cavity, to ensure that the temperature in the semi-closed cavity is kept within a certain range to provide a suitable temperature environment for spinning. The plurality of refrigeration devices 152 are fixedly mounted on a top of the frame 11. When the temperature of the spinning environment is high, the refrigeration device 152 can cool the semi-closed cavity.

The centrifugal spinning apparatus 1 further includes a control system 16 in signal connection to the spinning device 13, the feeding device 12, the temperature control device 15, and the collection device 14. The control system 16 controls an automatic operation of the entire device, and main process parameters thereof include: a feeding amount, a rotation speed of the spinneret 1340, a temperature of the spinning environment, and a moving speed of the collection belt 142.

Specifically, a working process of the centrifugal spinning apparatus 1 mainly includes the following steps:

- production parameters are manually set by the control system 16, including the environment temperature, the rotation speed of the spinneret 1340, a spinning fiber thickness, and the moving speed of the collection belt; and the control system 16 selects a quantity of the spinner devices 133 according to the set thickness of the spinning fiber;
- the control system 16 controls the feeding device 12 to feed the spinning device 14; and a volume of the spinning solution in the buffer tank is detected by the flow meter 125 and the liquid-level meter 122, and the feeding is stopped when a monitoring value reaches the set value;
- the control system 16 controls the temperature control device 15 to adjust the temperature of the semi-closed cavity on the frame 11, to ensure that spinning raw material are in a best spinning state;
- the control system 16 controls an operation of the transmission traction device 141 at the same time, to enable the moving speed of the collection belt 142 to reach the set value; and
- finally, the first motor 1337 is started, the spinneret 1340 starts to rotate at the high speed to spin, and the fibers formed by the spinning descend in the spiral line and are collected on the collection belt 142, and finally form the uniform centrifugal spinning fiber web 5.

It should be noted that, the centrifugal spinning fiber web 5 prepared in an initial stage is manually drawn to pass through the compaction device 2 and is wound into the winding device 3 for winding.

Figure 8:
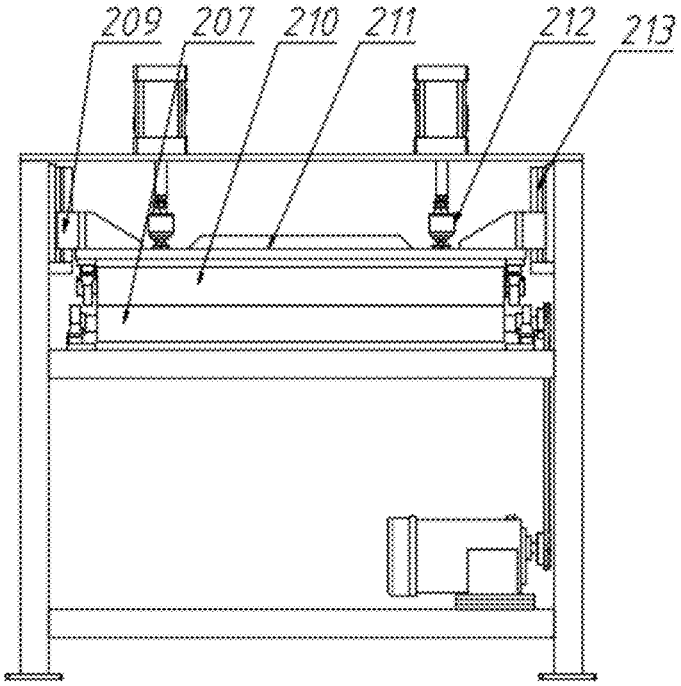
FIG. 8 is a schematic structural diagram of a compaction apparatus in FIG. 1.
Figure 9:
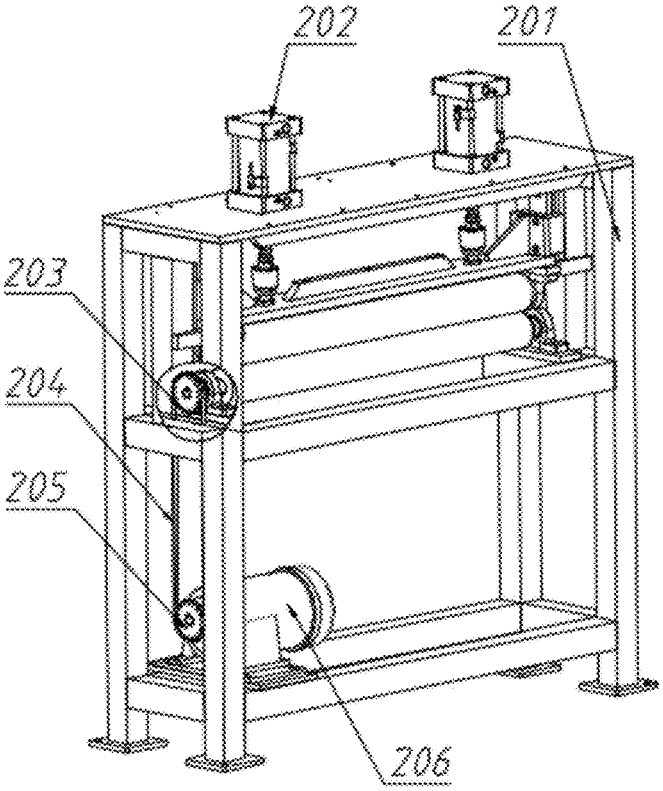
FIG. 9 is a schematic structural diagram of a compaction apparatus in FIG. 1 from another perspective.

Referring to FIG. 8 and FIG. 9, the compaction device 2 includes a compaction frame 201, a press roller 210 mounted on the compaction frame 201, a rotation roller 207, and a press roller mounting plate 211 for fixedly mounting the press roller 210. Sliders 209 are provided at two ends of the press roller mounting plate 211, and a slide rail 213 for the sliders 209 to slide is disposed on the compaction frame 201. The compaction device 2 further includes an air cylinder 202 disposed above the press roller mounting plate 211, a floating joint 212 is mounted on a piston rod of the air cylinder 202, and an end of the floating joint 212 abuts against the press roller mounting plate 211, to drive the press roller 210 to slide upward and downward along the slide rail 213 through stretch-out and draw-back of the piston rod.

In this implementation, the press roller 210 is fixedly mounted on the press roller mounting plate 211 by a bearing seat, two air cylinders 202 are symmetrically fixedly mounted on an upper portion of the compaction frame 201, two slide rails 213 are respectively fixedly mounted on two sides of the compaction frame 201, and sliders 209 are mounted on slide rails 213. The rotation roller 207 is fixedly mounted on the compaction frame 201 by the bearing seat. In this way, the air cylinder 202 drives the floating joint 212 to push the press roller 210 mounted on the press roller mounting plate 211 downward by stretch-out and draw-back of the piston rod, so that the press roller 210 and the rotation roller 207 are attached and pressed, to compact the centrifugal spinning fiber web 5 passing through the compaction device 2.

The compaction device 2 further includes a driving portion for driving the rotation roller 207 to rotate, where the driving portion includes a driving motor 206 having an output shaft, a compaction driving sprocket 205 mounted on the output shaft, a compaction driven sprocket 203 mounted on the rotation roller 207, and a compaction chain 204 in transmission connection with the compaction driving sprocket 205 and the compaction driven sprocket 203. The driving motor 206 drives the compaction driving sprocket 205 to drive the compaction driven sprocket 203 to rotate, to drive the rotation roller 207 to rotate.

In this implementation, the driving motor 206 is fixedly mounted on a lower portion of the compaction frame 201; the compaction driving sprocket 205 is fixedly mounted on the driving motor 206 in a keyed connection; the compaction driven sprocket 203 is fixedly mounted on an end of the rotation roller 207 in the keyed connection; the compaction chain 204 is sleeved on the driving sprocket and the driven sprocket; the driving motor 206 drives, through the driving sprocket and the compaction chain 204, the compaction driven sprocket 203 to rotate; the compaction driven sprocket 203 drives the rotation roller 207 to rotate; and in this way, the rotation roller 207 rotates when the centrifugal spinning fiber web 5 is compacted, generating a traction effect on the centrifugal spinning fiber web 5, and preventing the centrifugal spinning fiber web 5 from being torn off by the winding device 3 during the compacting.

Figure 10:
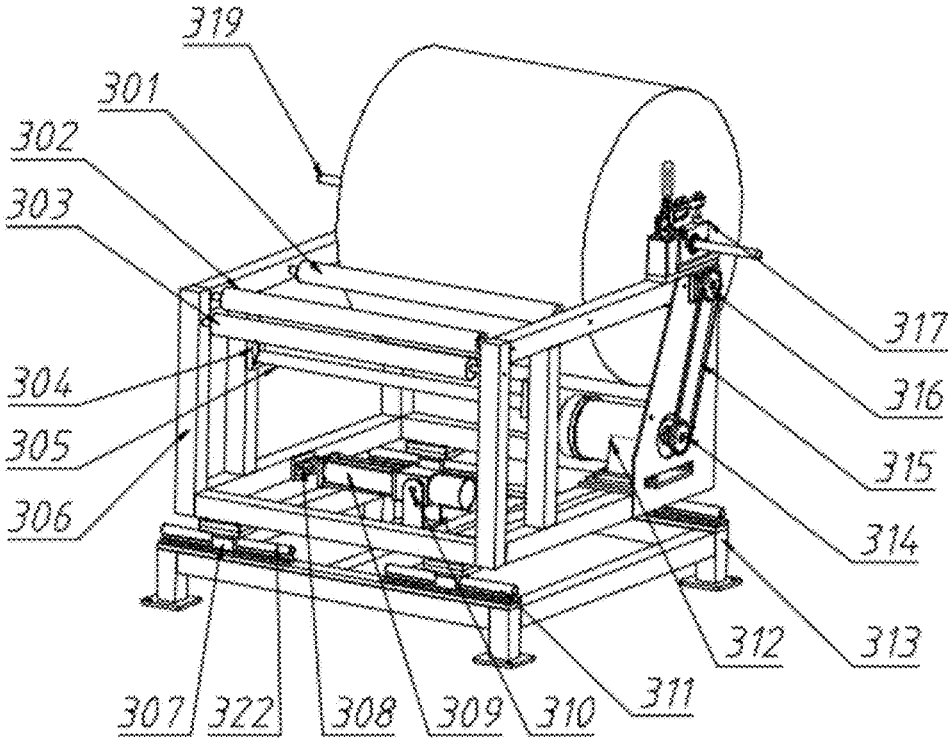
FIG. 10 is a schematic structural diagram of a winding device in FIG. 1.
Figure 11:
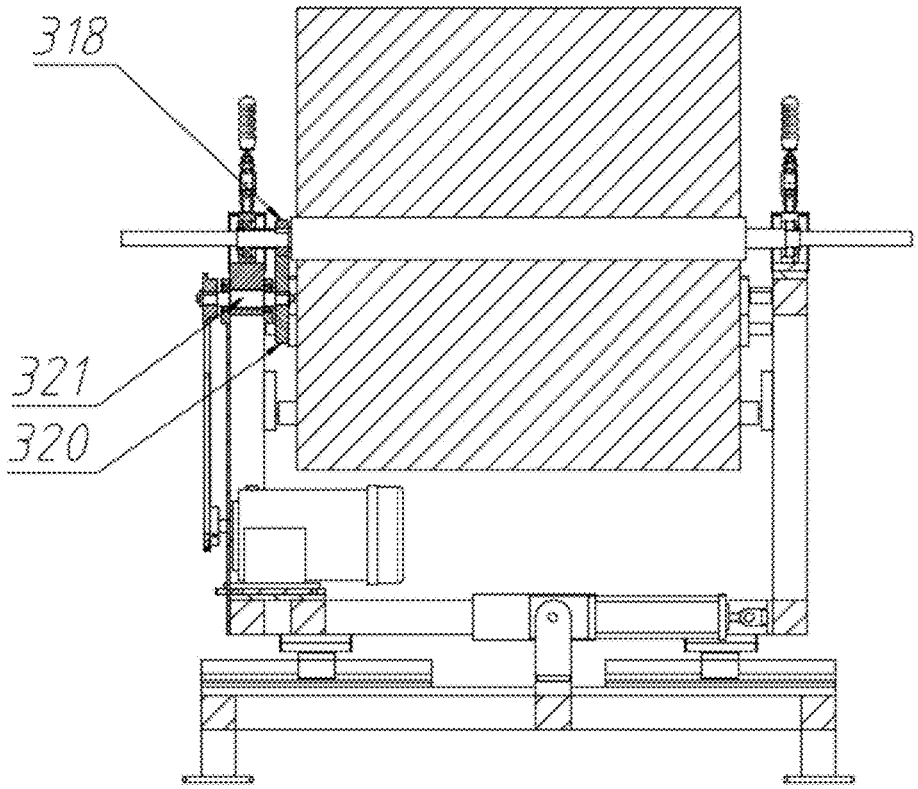
FIG. 11 is a cross-sectional view of the winding device shown in FIG. 10.

Referring to FIG. 10 and FIG. 11, the winding device 3 includes an upper winding frame 306, and a first guide roller 303, a limit roller 302, a tension adjusting roller 305, a second guide roller 301, and a winding roller 319 that are sequentially disposed on the upper winding frame 306 in a movement direction of the centrifugal spinning fiber web 5. The centrifugal spinning fiber web is guided into the winding device by the first guide roller and is wound on the winding roller after being guided by the tension adjusting roller and the second guide roller. The centrifugal spinning fiber web 5 is guided into the winding device 3 by the first guide roller 303 and is wound on the winding roller 319 after being guided by the tension adjusting roller 305 and the second guide roller 301. Particularly, the limit roller 302 is disposed obliquely above the first guide roller 303, thereby ensuring that the centrifugal spinning fiber web 5 is only disposed between the first guide roller 303 and the limit roller 302.

Guide blocks 304 are disposed at two sides of the upper winding frame 306, and the guide blocks 304 are provided with grooves for accommodating end portions of the tension adjusting roller 305. The two ends of the tension adjusting roller 305 are respectively mounted in the grooves of the two guide blocks 304 and slide in the grooves. In this way, the tension adjusting roller 305 is pressed on the centrifugal spinning fiber web 5 and adjusts a tension force of the centrifugal spinning fiber web 5 by gravity thereof.

Clamping mechanisms 317 are disposed at two sides of the upper winding frame 306, and two ends of the winding roller 319 are respectively clamped in two clamping mechanisms 317. The clamping mechanisms 317 clamp the winding roller 319 and bearings at two ends of the winding roller 319 into grooves of the clamping mechanisms 317, and the winding roller 319 freely rotates in the clamping mechanisms 317. When the winding is completed, the clamping mechanisms 317 are manually operated, and the winding roller 319 can be easily separated from the clamping mechanisms 317.

The winding device 3 further includes a winding motor 312 fixedly mounted at a bottom of the upper winding frame 306, a winding driving sprocket 314, a winding chain 315, a winding driven sprocket 316, and a winding driven shaft 321 mounted on the upper winding frame 306. Particularly, the winding driving sprocket 314 is fixedly mounted on an output shaft of the winding motor 312 in the keyed connection, the winding driven shaft 321 is mounted on the upper winding frame 306 by the bearing seat, the winding driven sprocket 316 is fixedly mounted on an end of the winding driven shaft 321 in the keyed connection, and the winding chain 315 is sleeved on the winding driving sprocket 314 and the winding driven sprocket 316. A driving gear 320 is fixedly mounted on another end of the winding driven shaft 321 in the keyed connection, a driven gear 318 is mounted on the winding roller 319, and the driving gear 320 is engaged with the driven gear 318.

In this way, the winding motor 312 drives, through the winding driving sprocket 314 and the winding chain 315, the winding driven sprocket 316 to rotate, the winding driven sprocket 316 drives the winding driven shaft 321 to rotate together, and during the rotation, the winding driven shaft 321 drives the driving gear 320 to rotate. The driving gear 320 transmits the power to the winding roller 319 by the driven gear 318, so that the winding roller 319 continuously rotates to ensure smooth completion of winding work.

The winding device 3 further includes a first deviation correcting device 322 for adjusting a position of the upper winding frame 306 to prevent deviation. The first deviation correcting device 322 is mounted on a lower portion of the upper winding frame 306, and includes a lower winding frame 313, a linear servo motor 309, a connecting seat 308 connecting an output shaft of the linear servo motor 309 and the upper winding frame 306, a deviation correcting slide rail 311 mounted on the lower winding frame 313, and a deviation correcting slider 307 mounted on the upper winding frame 306. The linear servo motor 309 is fixedly mounted on the lower winding frame 313 by motor fixing base 310. In this implementation, four deviation correcting slide rails 311 are symmetrically disposed on the lower winding frame 313, and four deviation correcting sliders 307 match the four deviation correcting slide rails 311 respectively and slide on the deviation correcting slide rails 311.

In this way, during the winding, the linear servo motor 309 drives the upper winding frame 306 to slide on the deviation correcting slide rails 311 by the deviation correcting sliders 307, to adjust a position of the winding roller 319 in real time to prevent deviation during the winding of the centrifugal spinning fiber web 5.

It should be noted that, a quantity and a position relationship of the deviation correcting slide rail 311 and the deviation correcting slider 307 are not limited thereto, and it only needs to be ensured that the deviation correcting slider 307 can slide on the corresponding deviation correcting slide rail 311 to adjust the position of the upper winding frame 306.

Embodiment 2

Figure 12:
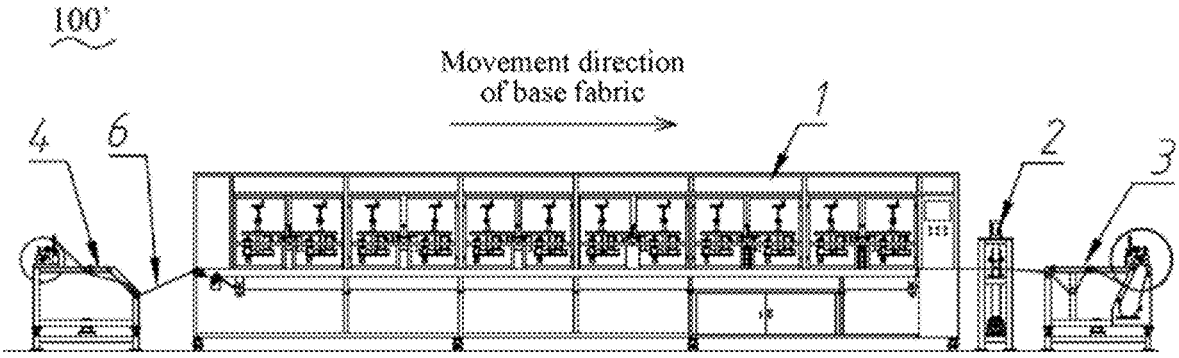
FIG. 12 is a schematic structural diagram of a planar receiving-type centrifugal spinning automatic production device according to Embodiment 2 of the present invention.

Referring to FIG. 12, a planar receiving-type centrifugal spinning automatic production device 100' is provided in Embodiment 2. The difference from Embodiment 1 lies in that, the planar receiving-type centrifugal spinning automatic production device 100' in Embodiment 2 further includes an unwinding device 4, where the unwinding device 4 is disposed at a front end of the centrifugal spinning apparatus 1, a base fabric 6 is wound on the unwinding device 4, the base fabric 6 is threaded into the centrifugal spinning apparatus 1 and tiled on the collection belt 142, and an end portion of the base fabric 6 is wound on the winding roller 319 of the winding device 3.

Figure 13:
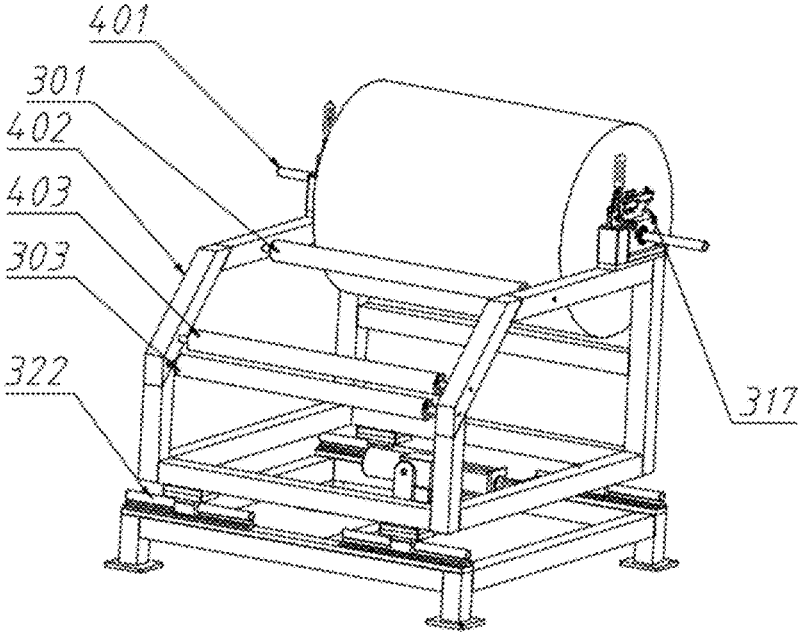
FIG. 13 is a schematic structural diagram of an unwinding device in FIG. 12.

Referring to FIG. 13, the unwinding device 4 includes an unwinding frame 402, and an unwinding roller 401, a second guide roller 301, a third guide roller 403, and a first guide roller 303 that are sequentially mounted on the unwinding frame 402 in a movement direction of the base fabric 6. An entire roll of the base fabric 6 is wounded on the unwinding roller 401, an end of the base fabric 6 sequentially passes through guide directions of the second guide roller 301, the third guide roller 403, and the first guide roller 303 to lead out the unwinding device 4. It should be noted that, the unwinding device 4 further includes a deviation correcting device for correcting a position of the unwinding frame 402, and the structure and the function principle of the deviation correcting device are basically the same as the first deviation correcting device 322, which is not described herein again. The unwinding device 4 further includes clamping mechanisms mounted on two sides of the unwinding roller 401 on the unwinding frame 402, and the structure and the function principle of the clamping mechanisms are basically the same as the clamping mechanisms 317 of the winding roller 319, which is not described herein again.

The unwinding roller 401 is an inflatable shaft. The unwinding roller 401 is not inflated when winding, after the entire roll of the base fabric 6 is manually sleeved on the unwinding roller 401, the unwinding roller 401 is inflated to fix the entire roll of the base fabric 6 to the unwinding roller 401, and the clamping mechanisms are opened manually to clamp two ends of the unwinding roller 401 into the clamping mechanisms.

In addition to the foregoing differences, the structure of the planar receiving-type centrifugal spinning automatic production device 100' of this embodiment is basically the same as that of the planar receiving-type centrifugal spinning automatic production device 100 of Embodiment 1, which is not described herein again.

During specific use, the spinning solution in the spinneret 1340 is ejected during high-speed rotation of the spinneret 1340, due to the action of centrifugal force and gravity, the spinning solution is formed into fibers instantly at the moment of ejection, and the fibers are attached to the base fabric 6 on the collection belt 142 to form the fiber web; and the collection belt 142 is driven by the winding device 3 to move forward, the fiber web is tiled on the base fabric 6 uniformly, and the formed centrifugal spinning fiber web 5 having the base fabric 6 is compacted by the compaction device 2 and is wound in the winding device 3 to form into rolls.

Embodiment 3

Figure 14:
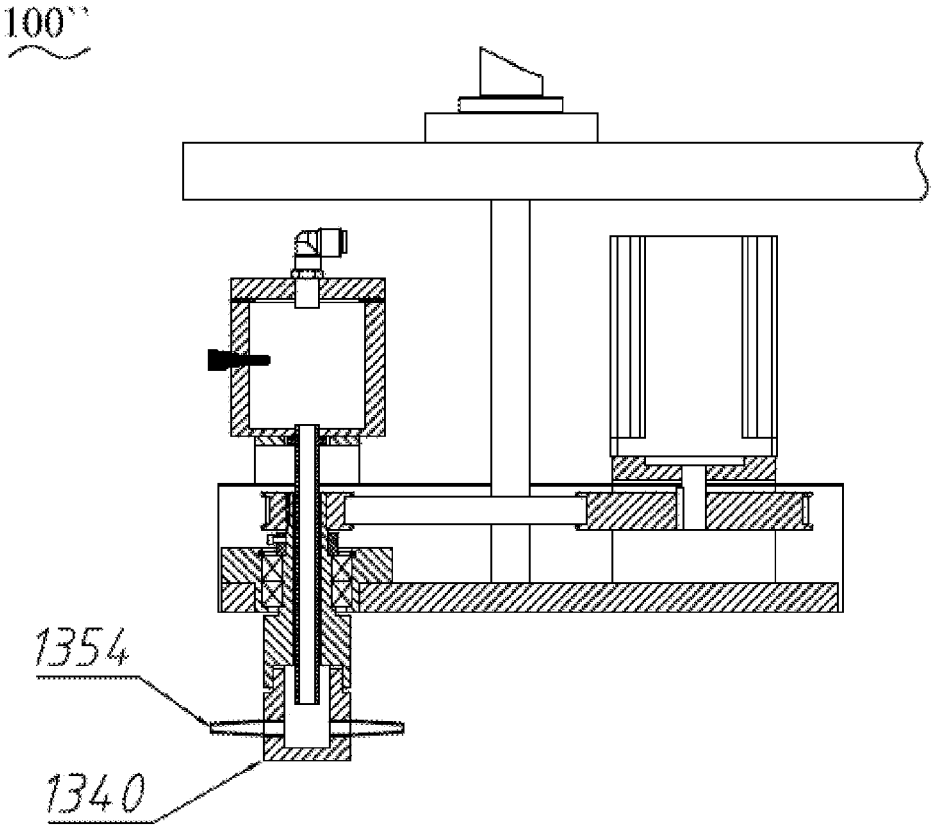
FIG. 14 is a cross-sectional view of a spinning device of a planar receiving-type centrifugal spinning automatic production device according to Embodiment 3 of the present invention.

Referring to FIG. 14, a plane receiving-type automatic centrifugal spinning production apparatus 100" is provided in Embodiment 3. The difference from Embodiment 1 lies in that at least one spinning nozzle 1354 is mounted on the spinneret 1340 of the spinner device 133 of Embodiment 3. A cross section of the spinning nozzle 1354 is triangular (as shown in FIG. 14), an inner diameter thereof gradually decreases to form a cone, and the spinning solution in the spinneret 1340 is ejected from the spinning nozzle 1354.

In addition to the foregoing differences, the structure of the planar receiving-type centrifugal spinning automatic production device 100" of this embodiment is basically the same as that of the planar receiving-type centrifugal spinning automatic production device 100 of Embodiment 1, which is not described herein again.

Embodiment 4

Figure 15:
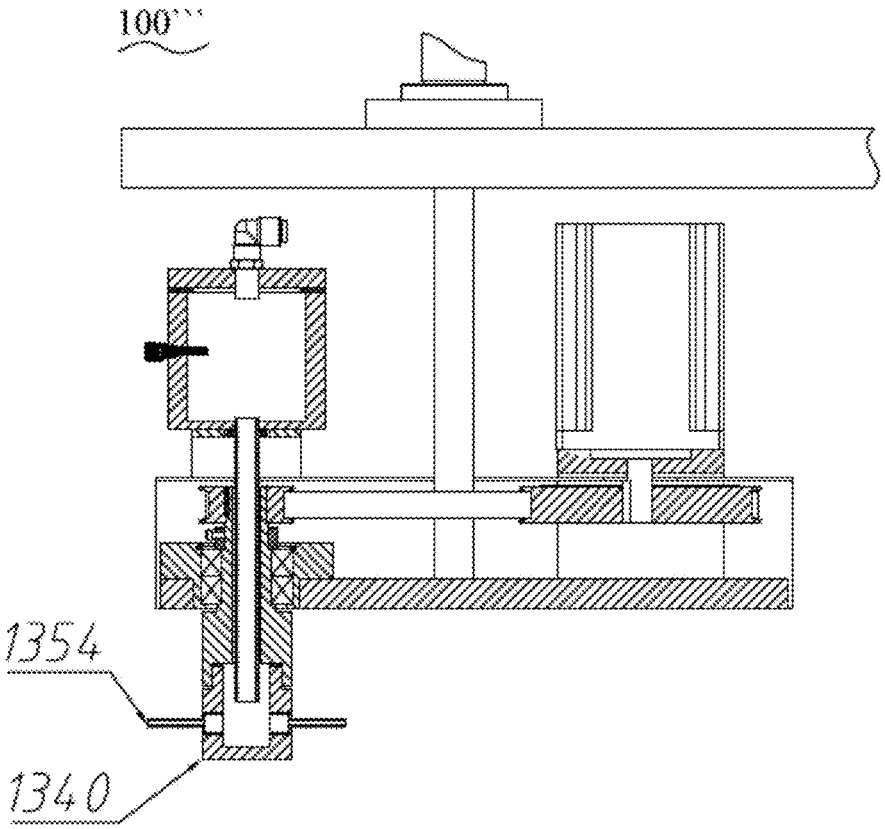
FIG. 15 is a cross-sectional view of a spinning device of a planar receiving-type centrifugal spinning automatic production device according to Embodiment 4 of the present invention.

Referring to FIG. 15, a plane receiving-type automatic centrifugal spinning production apparatus 100''' is provided in Embodiment 4. The difference from Embodiment 1 lies in that at least one spinning nozzle 1354 is mounted on the spinneret 1340 of the spinner device 133 of Embodiment 4. A cross section of the spinning nozzle 1354 is stepped-shaped (as shown in FIG. 15), and the spinning solution in the spinneret 1340 is ejected from the spinning nozzle 1354.

In addition to the foregoing differences, the structure of the planar receiving-type centrifugal spinning automatic production device 100''' of this embodiment is basically the same as that of the planar receiving-type centrifugal spinning automatic production device 100 of Embodiment 1, which is not described herein again.

Embodiment 5

Figure 16:
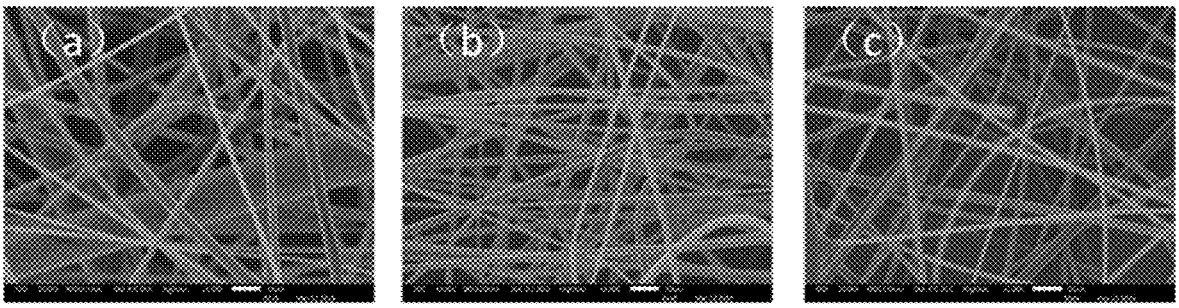
FIG. 16 (*a*), FIG. 16 (*b*), and FIG. 16 (*c*) are respectively electron micrographs of fibers produced in Embodiment 5, Embodiment 6, and Embodiment 7.
Figure 17:
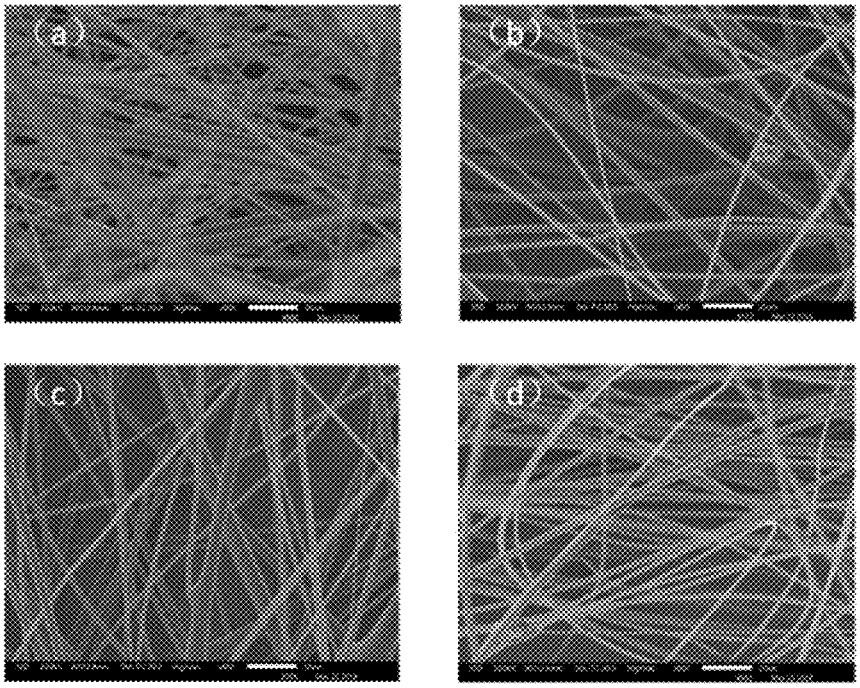
FIG. 17 (*a*), FIG. 17 (*b*), FIG. 17 (*c*), and FIG. 17 (*d*) are respectively electron micrographs of fibers produced in Embodiment 7 to Embodiment 10.
Figure 18:
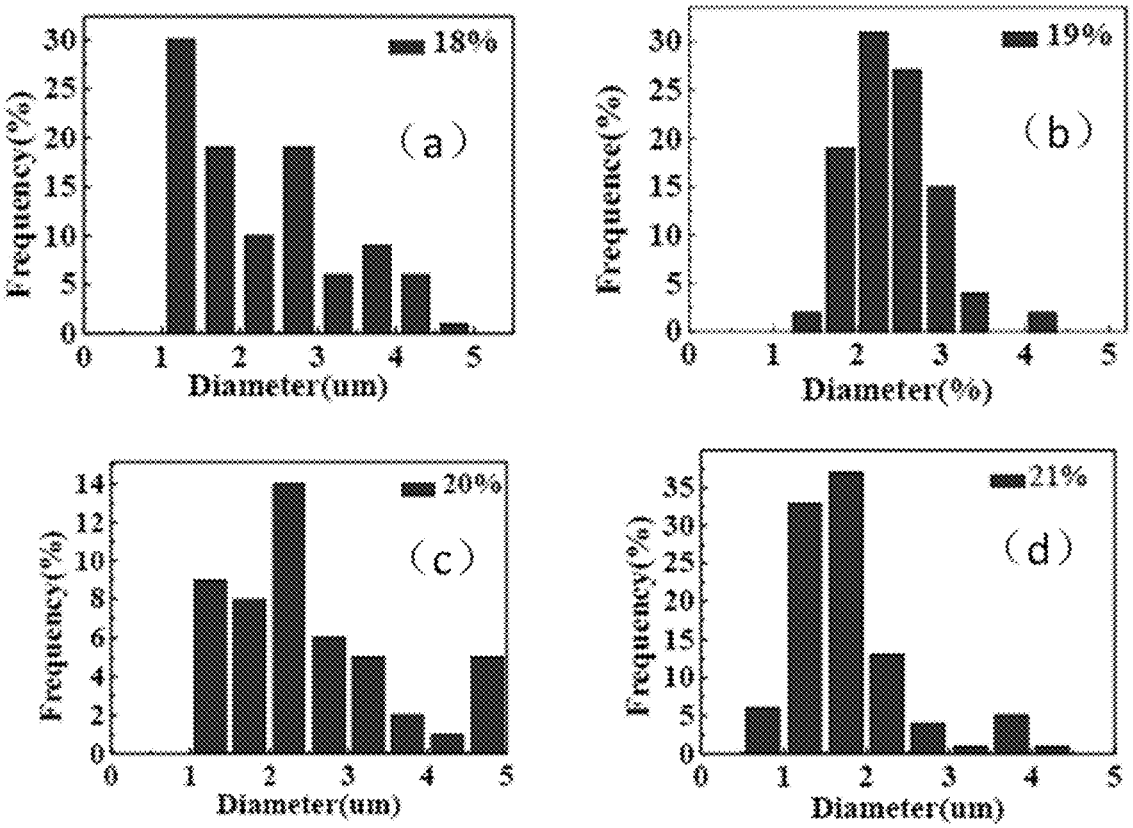
FIG. 18 (*a*), FIG. 18 (*b*), FIG. 18 (*c*), and FIG. 18 (*d*) are histograms of diameter frequency distributions of fibers produced in Embodiment 8.
Figure 19:
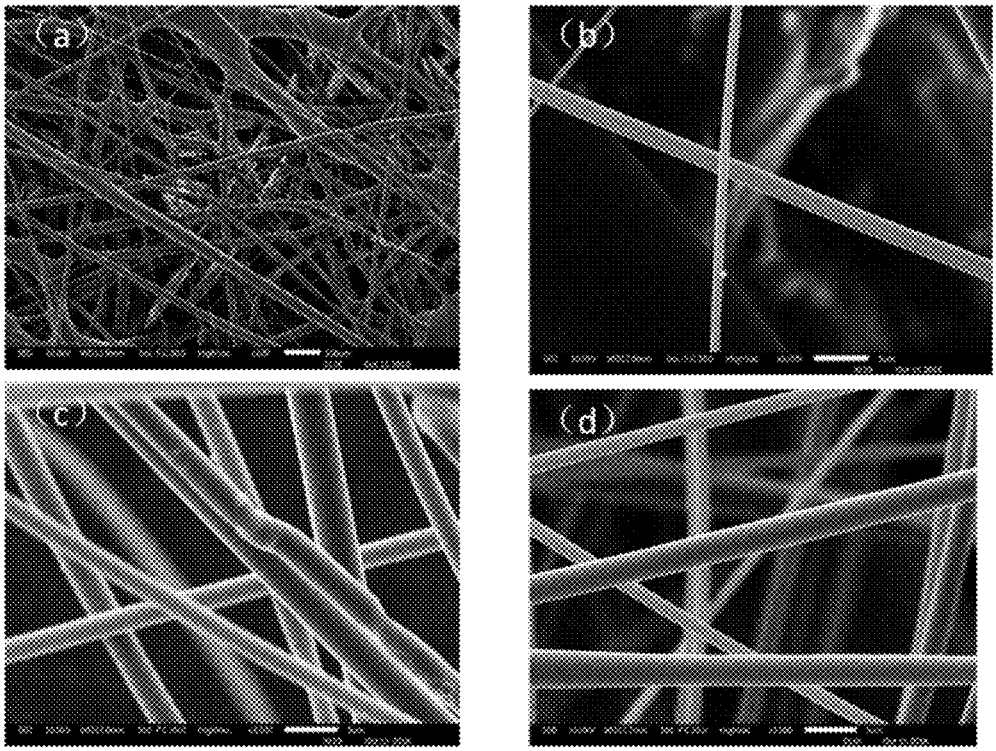
FIG. 19 (*a*), FIG. 19 (*b*), FIG. 19 (*c*), and FIG. 19 (*d*) are respectively electron micrographs of fibers produced at 0s, 15s, 30s, and 45s in Embodiment 11.
Figure 20:
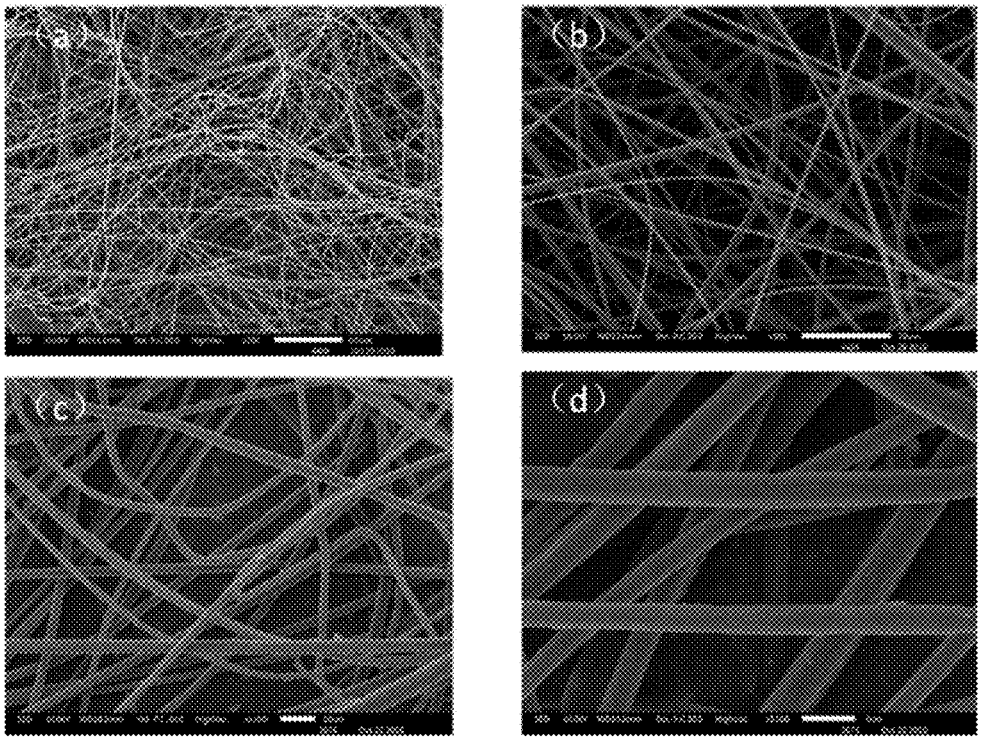
FIG. 20 (*a*), FIG. 20 (*b*), FIG. 20 (*c*), and FIG. 20 (*d*) are respectively electron micrographs of fibers produced at 0s, 15s, 30s, and 45s in Embodiment 12.
Figure 21:
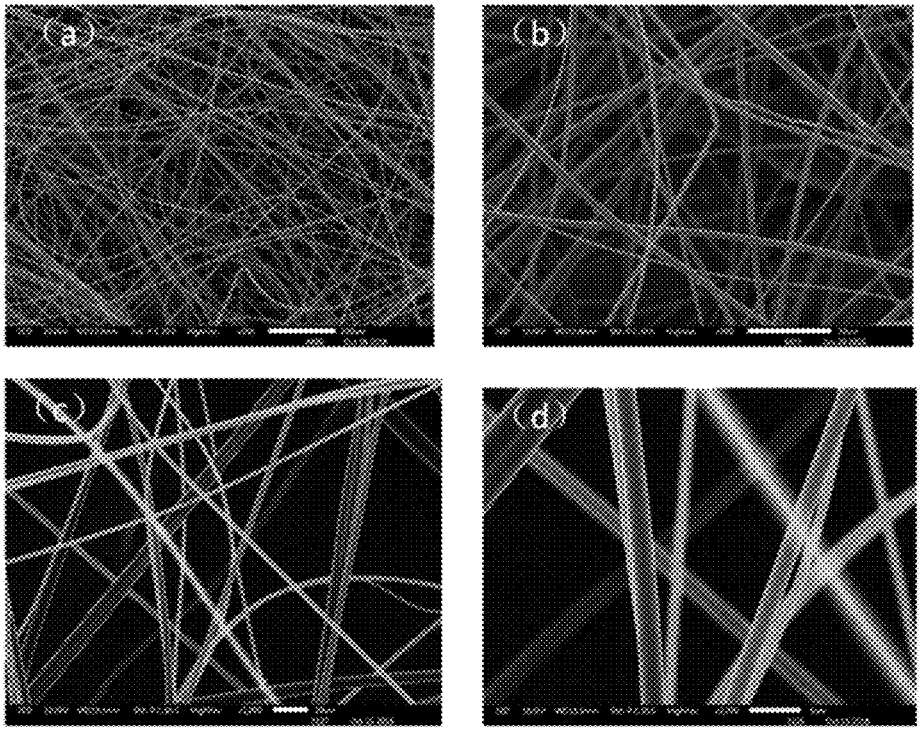
FIG. 21 (*a*), FIG. 21 (*b*), FIG. 21 (*c*), and FIG. 21 (*d*) are respectively electron micrographs of fibers produced at 0s, 15s, 30s, and 45s in Embodiment 13.
Figure 22:
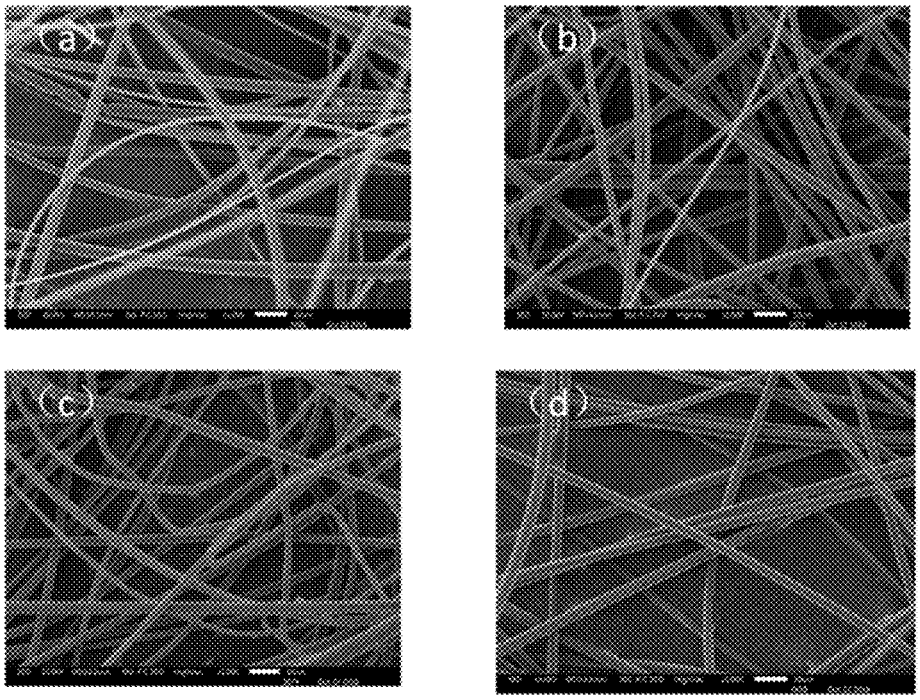
FIG. 22 (*a*), FIG. 22 (*b*), FIG. 22 (*c*), and FIG. 22 (*d*) are respectively electron micrographs of fibers produced at 0s, 15s, 30s, and 45s in Embodiment 14.

Referring to FIG. 16 to FIG. 18, the present invention further specifically relates to a plane receiving-type centrifugal spinning method, and specific steps are as follows:

1) putting polyvinyl butyral (PVB) powder into a vacuum drying oven, and drying at 70° C. for 8 hours;
2) adding absolute ethanol to the polyvinyl butyral (PVB) powder, and preparing the spinning solution with a mass fraction of 10%;
3) subjecting the spinning solution to water bath, at 80 to 90° C., over stirring by a mechanical stirrer at a constant speed for 8 hours, and placing the spinning solution in a vacuum box to stand for 1 hour, to enable bubbles in the spinning solution to disappear as much as possible; and 4) spinning by using the apparatus in Embodiment 3, adjusting test parameters by the control system, setting the spinning environment temperature at 25° C., selecting a spinner device, and setting the spinneret with a rotation speed of 3000 r/min, a spinning aperture of 1 mm, and a distance between the collection belt and the spinneret being 50 mm.

Embodiment 6

A plane receiving-type centrifugal spinning method includes the following specific steps:

1) putting polyvinyl butyral (PVB) powder and polyacrylonitrile (PAN) powder in a vacuum drying oven respectively, and drying at 30° C. for 8 hours; and using N,N-dimethylformamide (DMF) as a solvent;
2) a mass ratio of the PVB, the PAN and the DMF being 1.5:1:10;
3) pouring the weighed DMF into a beaker, turning on the stirrer at a speed of 520 r/min, to stir the DMF, slowly pouring the PAN powder into the DMF for stirring, and finally pouring the PVB powder to the DMF for stirring for 4 hours; and after stirring, placing the formed spinning solution in a vacuum box to stand for 1 hour, to enable bubbles in the spinning solution to disappear as much as possible; and
4) spinning by using the apparatus in Embodiment 3, adjusting test parameters by the control system, setting the spinning environment temperature at 45° C., selecting a spinner device, setting the spinneret with a rotation speed of 8000 r/min, a spinning aperture being 0.2 mm, and a distance between the collection belt and the spinneret being 80 mm.

Embodiment 7

A plane receiving-type centrifugal spinning method includes the following specific steps:

1) putting polyacrylonitrile (PAN) powder in a vacuum drying oven, and drying at 30° C. for 8 hours; and using N,N-dimethylformamide (DMF) as a solvent;
2) a mass fraction of the PAN being 18%;
3) turning on the stirrer at a speed of 520 r/min, to stir the DMF, and slowly pouring the PAN powder to the DMF for stirring for 4 hours; and after stirring, placing the formed spinning solution in a vacuum box to stand for 1 hour, to enable bubbles in the spinning solution to disappear as much as possible; and
4) spinning by using the apparatus in Embodiment 3, adjusting test parameters by the control system, setting the spinning environment temperature at 25° C., selecting a spinner device, and setting the spinneret with a rotation speed of 3000 r/min, a spinning aperture being 0.2 mm, and a distance between the collection belt and the spinneret being 50 mm.

Embodiment 8 to Embodiment 10

The difference between Embodiment 8 to Embodiment 10 and Embodiment 7 lies in that, the mass fraction of the PAN in Embodiment 8 is 19%; the mass fraction of the PAN in Embodiment 9 is 20%; the mass fraction of the PAN in Embodiment 10 is 21%; and other conditions are consistent with Embodiment 7.

In view of the comparison of histograms of diameter frequency distributions of fibers (FIG. 18) at different concentrations, fiber diameters are mostly in a range of 1 to 5 where components at 21% have a small amount of nanofibers. As the concentration increases, the fiber diameter becomes larger. Because as the concentration of the solution increases, viscosity of the solution increases, a force between molecular chains becomes larger, and the molecular chain is more difficult to draw and stretch at the same rotation speed, resulting in a larger diameter.

Embodiment 11 to Embodiment 14

Referring to FIG. 19 to FIG. 22, the difference from Embodiment 5 lies in that, the rotation speed of the spinneret in Embodiment 11 is set to 5000 r/min; the rotation speed of the spinneret in Embodiment 12 is set to 6000 r/min; the rotation speed of the spinneret in Embodiment 13 is set to 7000 r/min; the rotation speed of the spinneret in Embodiment 14 is set to 8000 r/min; and other conditions are consistent with Embodiment 5.

Real-time shooting is performed by a high-speed camera with experimental records at 0s, 15s, 30s, and 45s. In a range of 5000 rpm to 6000 rpm, the centrifugal force of the PVB spinning solution ejected from the spinning nozzle gradually increases and is promptly released from the negative pressure field of the rotating spinneret under the action of the inertial force, so that a better spinning trajectory is formed around the spinneret.

Embodiment 15 to Embodiment 18

Figure 23:
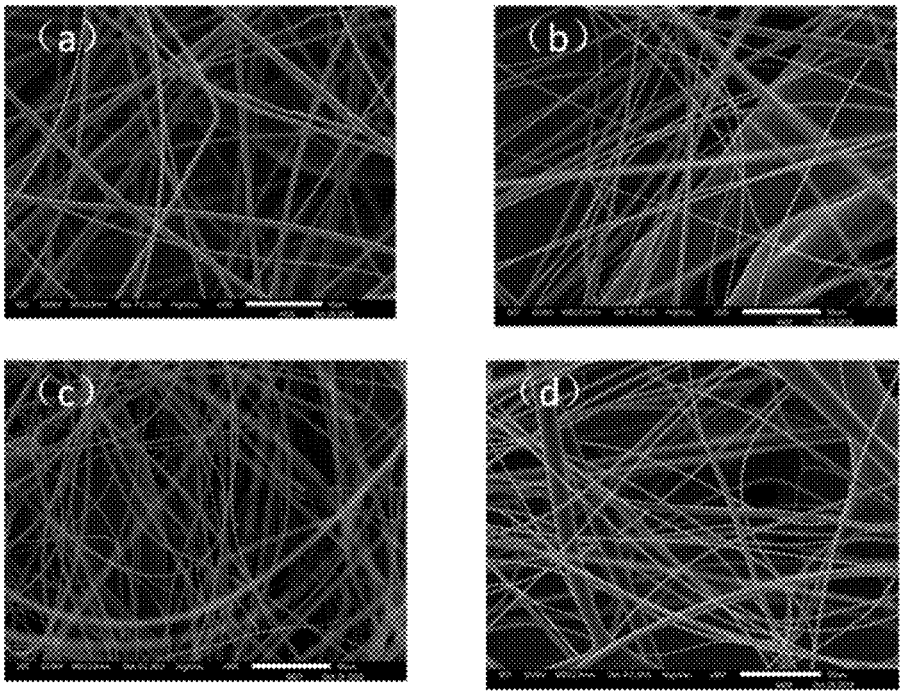
FIG. 23 (*a*), FIG. 23 (*b*), FIG. 23 (*c*), and FIG. 23 (*d*) are respectively electron micrographs of fibers produced at 10° C., 25° C., 40° C., and 55° C. in Embodiment 15 to Embodiment 18.

Referring to FIG. 23, the difference from Embodiment 5 lies in that, in Embodiment 15, test parameters are adjusted by the control system, and the spinning environment temperature is set to 10° C.; in Embodiment 16, test parameters are adjusted by the control system, and the spinning environment temperature is set to 25° C.; in Embodiment 17, test parameters are adjusted by the control system, and the spinning environment temperature is set to 40° C.; in Embodiment 18, test parameters are adjusted by the control system, and the spinning environment temperature is set to 55° C.; and other conditions are consistent with Embodiment 5.

When the temperature is 10° C., the PVB spinning solution presents a typical viscous behavior. As the temperature rises, an elastic behavior of a PVB spinning solution system increases at this time. After a gel point, the PVB spinning solution presents the typical elastic behavior at this time, and no occurrence of a plateau indicates that a gel process of the PVB spinning solution is a physical process.

Embodiment 19

The difference from the Embodiment 5 lies in that Embodiment 19 uses the apparatus in Embodiment 1 for spinning. The spinneret 1340 in Embodiment 1 is processed with through holes 1348, and the spinning solution is ejected from the through holes 1348 during the high-speed rotation of the spinneret 1340.

Embodiment 20

Figure 24:
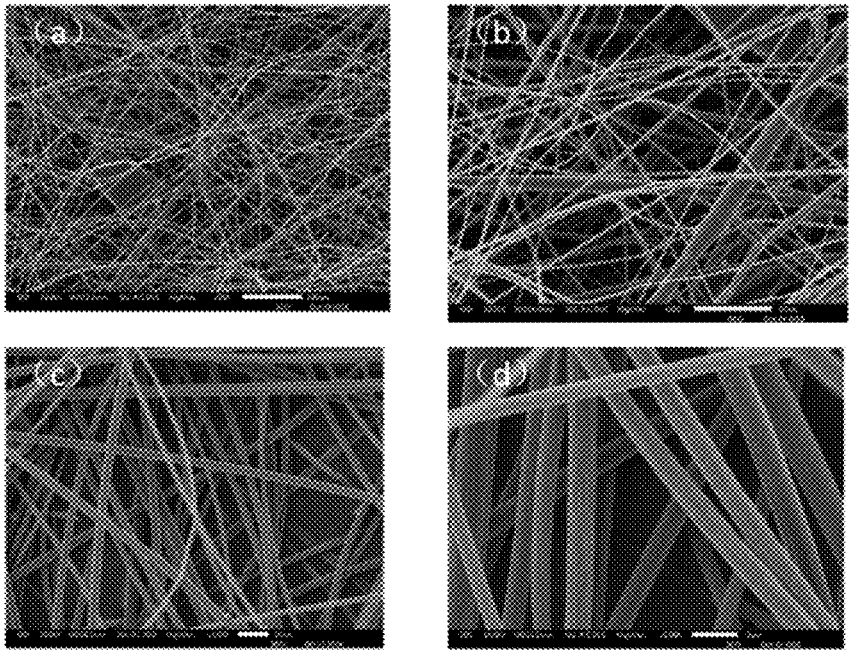
FIG. 24 (*a*), FIG. 24 (*b*), FIG. 24 (*c*), and FIG. 24 (*d*) are respectively electron micrographs of fibers produced at 0s, 15s, 30s, and 45s when using a PVB solution and an apparatus in Embodiment 4.
Figure 25:
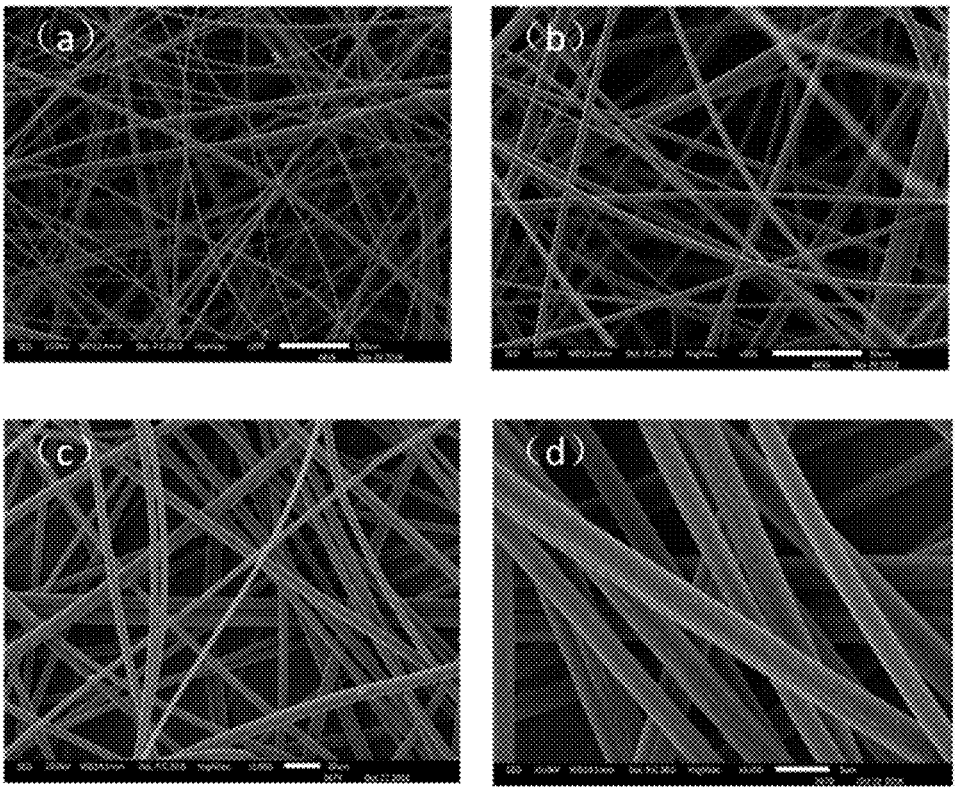
FIG. 25 (*a*), FIG. 25 (*b*), FIG. 25 (*c*), and FIG. 25 (*d*) are respectively electron micrographs of fibers produced at 0s, 15s, 30s, and 45s when using a PVB solution and an apparatus in Embodiment 3.

Referring to FIG. 24 to FIG. 25, the difference from Embodiment 5 lies in that Embodiment 20 uses the apparatus in Embodiment 4 for spinning. The spinning nozzle 1354 is mounted on the spinneret 1340 in Embodiment 4, the structure of the spinning nozzle 1354 is stepped-shaped, and the spinning solution in the spinneret 1340 is ejected from the spinning nozzle 1354.

The processes of centrifugal spinning in Embodiment 5, Embodiment 19 and Embodiment 20 are captured by the high-speed camera, and are photographed at the four time points of 0s, 5s, 10s, and 15s.

In Embodiment 5, the PVB spinning solution is ejected from the cone-shaped spinning nozzle, is formed into PVB fibers after stretching, compressing, and curing, and takes the spiral line as the spinning trajectory. The fibers are collected on a fiber collection surface under the action of the gravity thereof. A radius of the spinning trajectory is relatively large, and therefore the PVB fibers are less affected by the force of the negative pressure field below the rotated spinneret, and the spinning trajectory has better stability.

In Embodiment 19, the PVB spinning solution is turned into droplets and falls on the collection belt, and the PVB centrifugal spinning cannot be performed under this condition.

In Embodiment 20, the PVB spinning solution is ejected from the stepped-shaped spinning nozzle, is formed into PVB fibers after stretching, compressing, and curing, and takes the spiral line as the spinning trajectory. On the one hand, the fibers are collected on the collection belt under the joint action of the gravity thereof and the negative pressure field below the rotated spinneret. On the other hand, under the action of the negative pressure field below the rotated spinneret, the PVB fibers collected on the collection belt tend to move toward the bottom of the spinneret, thereby winding on an outer wall of the spinneret and the spinning nozzle.

Embodiment 21 to Embodiment 23

Figure 26:
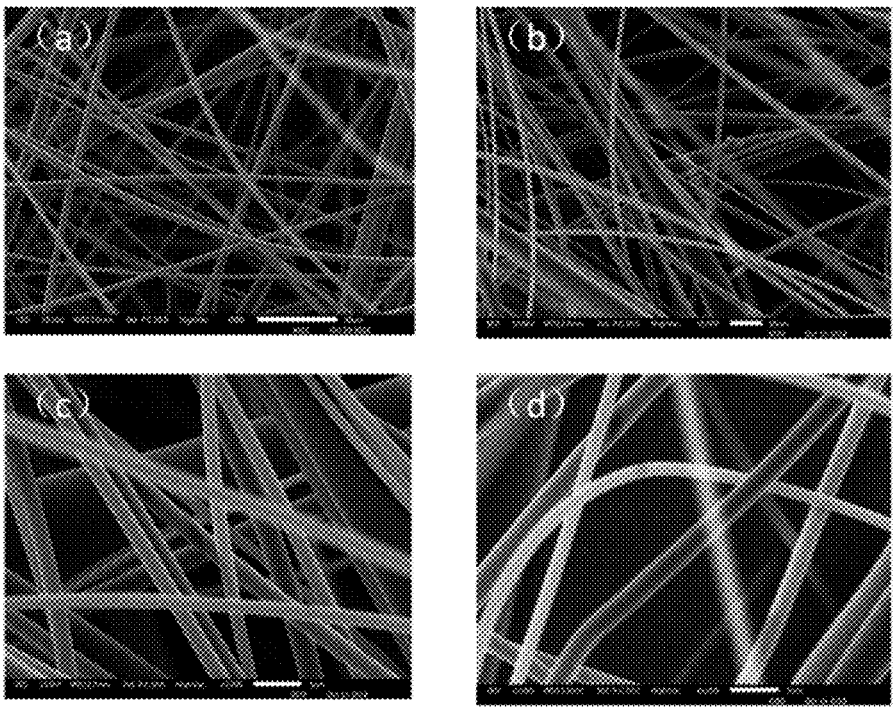
FIG. 26 (*a*), FIG. 26 (*b*), FIG. 26 (*c*), and FIG. 26 (*d*) are respectively electron micrographs of fibers produced at 0s, 15s, 30s, and 45s in Embodiment 21.
Figure 27:
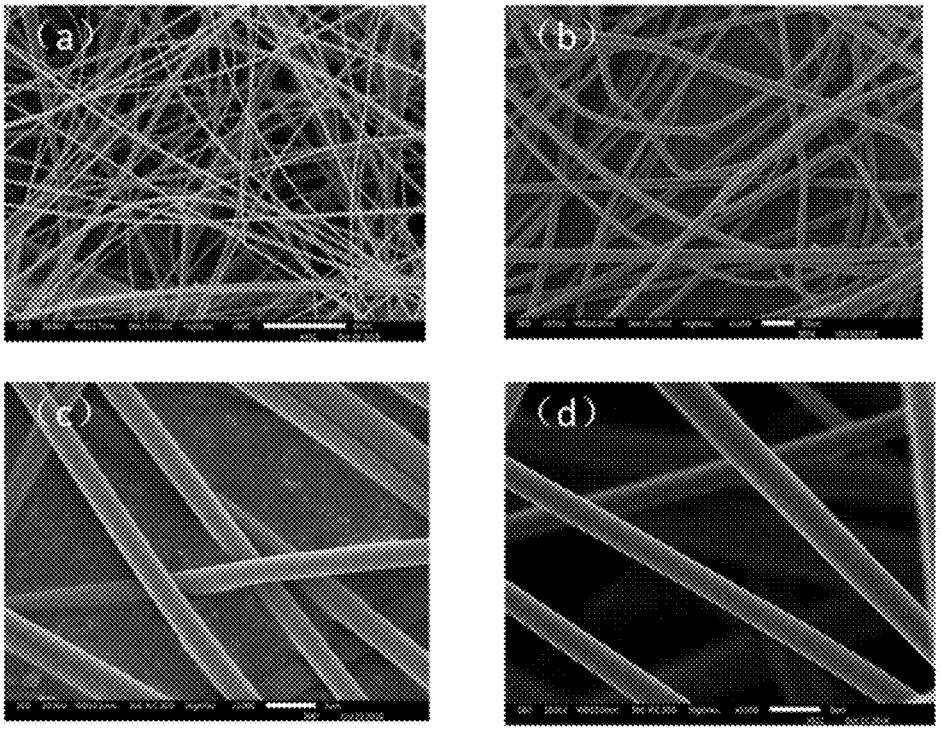
FIG. 27 (*a*), FIG. 27 (*b*), FIG. 27 (*c*), and FIG. 27 (*d*) are respectively electron micrographs of fibers produced at 0s, 15s, 30s, and 45s in Embodiment 22.
Figure 28:
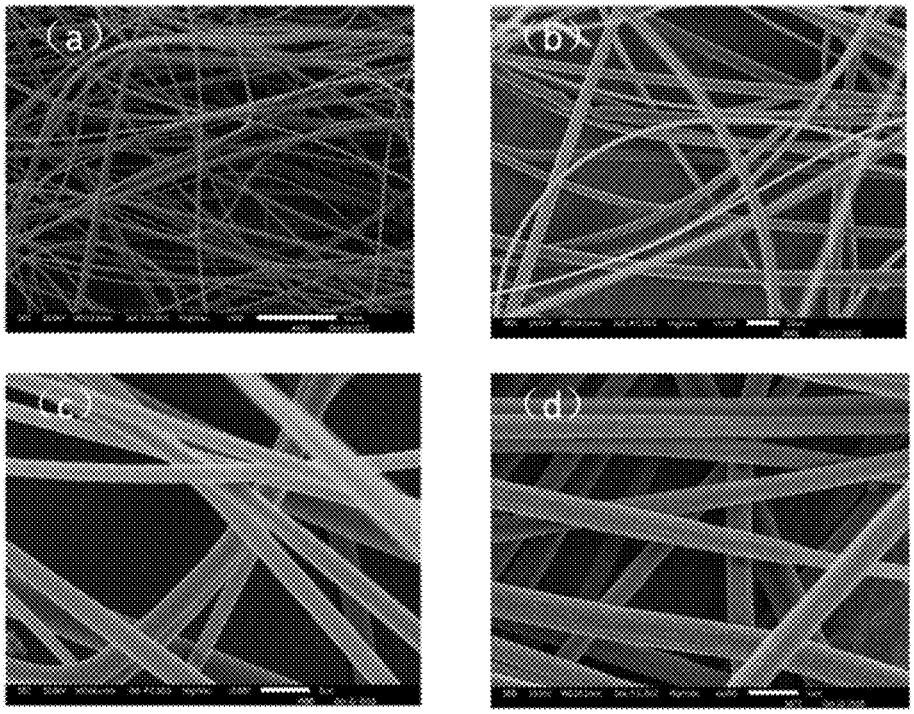
FIG. 28 (*a*), FIG. 28 (*b*, FIG. 28 (*c*), and FIG. 28 (*d*) are respectively electron micrographs of fibers produced at 0s, 15s, 30s, and 45s in Embodiment 23.

Referring to FIG. 26 to FIG. 28, the difference from Embodiment 5 lies in that the spinneret aperture in Embodiment 21 is 0.25 mm; the spinneret aperture in Embodiment 22 is 0.41 mm; the spinneret aperture in Embodiment 23 is 0.64 mm; and other conditions are consistent with Embodiment 5.

The experimental process is captured by the high-speed camera, and real-time capturing is performed at four time points of 0s, 15s, 30s, and 45s. As an aperture of the spinning nozzle deceases, the surface evenness of the diameter between the prepared PVB fibers is improved. However, there are more multifilaments in the prepared PVB fibers, that is, there are a plurality of fibers in a PVB fiber.

Embodiment 24 to Embodiment 25

Figure 29:
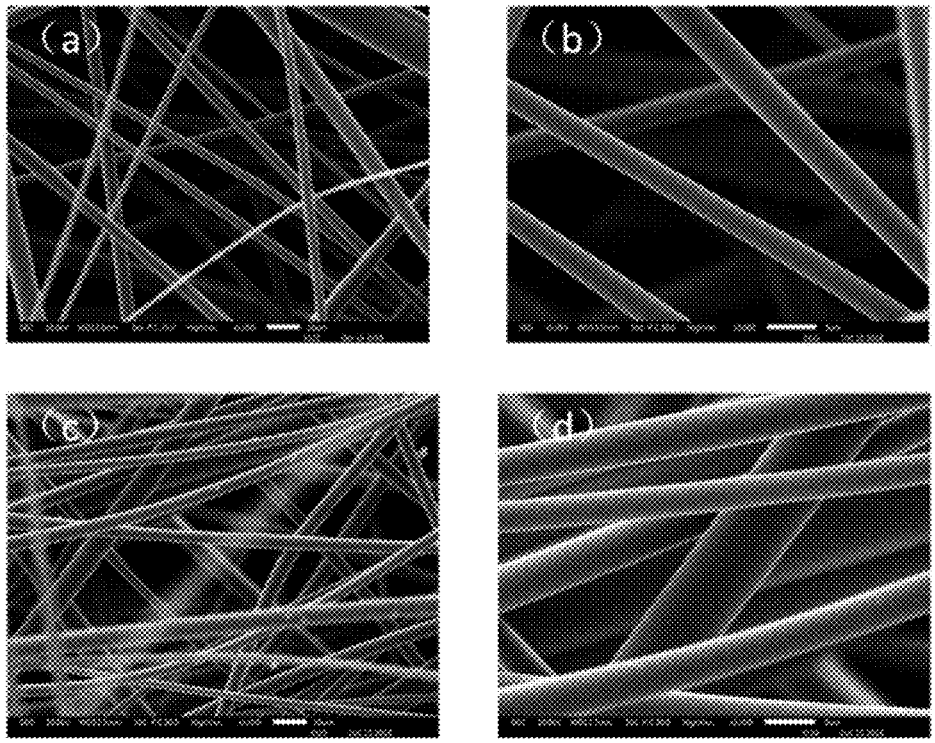
FIG. 29 (*a*), FIG. 29 (*b*), FIG. 29 (*c*), and FIG. 29 (*d*) are respectively electron micrographs of fibers produced at 0s, 15s, 30s, and 45s in Embodiment 24.
Figure 30:
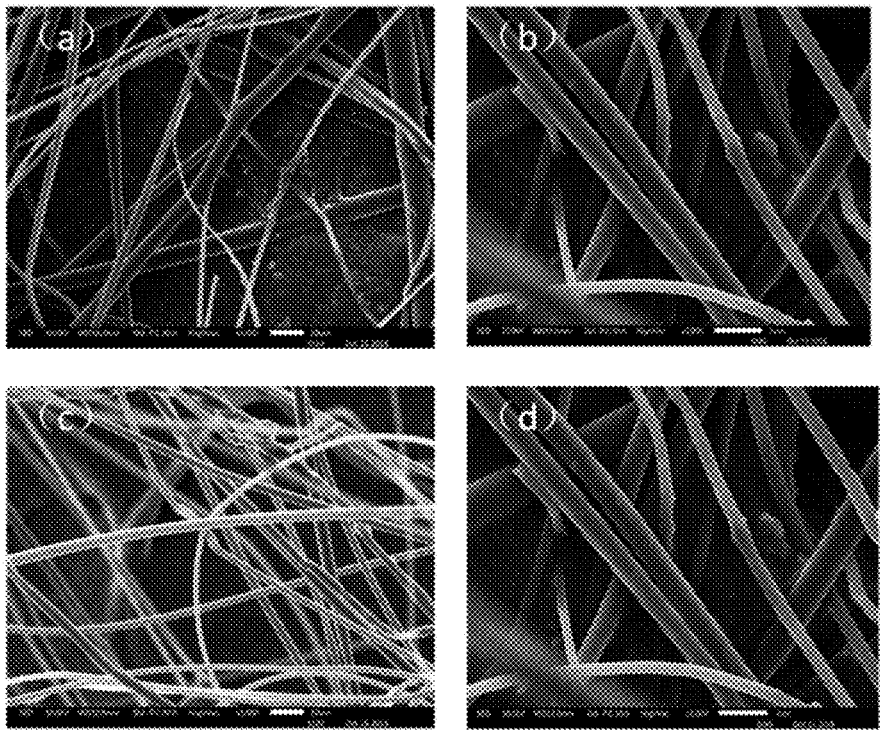
FIG. 30 (*a*), FIG. 30 (*b*), FIG. 30 (*c*), and FIG. 30 (*d*) are respectively electron micrographs of fibers produced at 0s, 15s, 30s, and 45s in Embodiment 25.

Referring to FIG. 29 to FIG. 30, the difference from Embodiment 5 lies in that in Embodiment 24, a distance between the collection belt and the spinneret is 40 mm; and in Embodiment 25, the distance between the collection belt and the spinneret is 60 mm.

The experimental process is captured by the high-speed camera, and real-time capturing is performed at four time points of 0s, 15s, 30s, and 45s.

As the collection height increases, there are more multifilaments in the prepared PVB fibers, that is, there are a plurality of fibers in a PVB fiber, and the diameter unevenness between the PVB fibers gradually increases.

Finally, it should be noted that the foregoing embodiments are merely used for describing the technical solutions of the present invention, but are not intended to limit the present invention. Although the present invention is described in detail with reference to the foregoing embodiments, it should be appreciated by a person skilled in the art that, modifications may still be made to the technical solutions recorded in the foregoing embodiments, or equivalent replacements may be made to the part of all of the technical features; and these modifications or replacements will not cause the essence of corresponding technical solutions to depart from the technical solutions in the embodiments of the present invention.

We claim:

1. A centrifugal spinning apparatus, comprising: a frame, a spinning device, a feeding device for providing a spinning solution to the spinning device, and a collection device for collecting centrifugal spinning fibers ejected by the spinning device, wherein the collection device is horizontally disposed below the spinning device, to enable the centrifugal spinning fibers ejected by the spinning device to be attached to a surface of the collection device; wherein the spinning device comprises a spinner device and a transverse device driving the spinner device to reciprocate horizontally in a direction perpendicular to an extending direction of the collection device.

2. The centrifugal spinning apparatus according to claim 1, wherein a negative pressure is formed on the surface of the collection device, and the negative pressure absorbs the centrifugal spinning fibers attached to the surface of the collection device onto the collection device.

3. The centrifugal spinning apparatus according to claim 1, wherein the spinner device comprises a buffer tank connected to the feeding device, a spinneret ejecting the centrifugal spinning fibers, and a feeding pipe communicated with the buffer tank and the spinneret; and an end of the feeding pipe extends into the buffer tank, and another end extends into the spinneret, to guide a spinning solution from the buffer tank to the spinneret.

4. The centrifugal spinning apparatus according to claim 3, wherein at least one spinning nozzle is disposed on the spinneret, a cross section of the spinning nozzle is triangular or step-shaped, and the spinning solution in the spinneret is ejected through the spinning nozzle.

5. The centrifugal spinning apparatus according to claim 3, wherein the spinner device further comprises a hollow shaft sleeved around a periphery of the feeding pipe, and the feeding pipe is not in contact with an inner wall of the hollow shaft.

6. The centrifugal spinning apparatus according to claim 5, wherein the spinneret is fixedly mounted at a lower end of the hollow shaft.

7. The centrifugal spinning apparatus according to claim 6, wherein the spinner device further comprises a power portion driving the spinneret to rotate, the power portion comprising a first motor having an output shaft, a driving pulley connected to the output shaft, a driven pulley connected to the hollow shaft, and a timing belt in transmission connection with the driving pulley and the driven pulley, to enable the first motor to drive the driving pulley to drive the driven pulley to rotate, thereby driving the spinneret connected to the hollow shaft to rotate.

8. The centrifugal spinning apparatus according to claim 3, wherein the transverse device comprises a fixed support connected to the frame, a transversely movable unit mounted on the fixed support, a slider mounted on the transversely movable unit, a mounting plate connected to the slider, and a transverse strut connected to the mounting plate, the transversely movable unit driving the transverse strut to reciprocate in an extending direction of the transversely movable unit by the slider.

9. The centrifugal spinning apparatus according to claim 8, wherein an extending direction of the transverse strut and the extending direction of the transversely movable unit are perpendicular to each other, and two spinner devices are symmetrically mounted at two ends of the transverse strut.

10. The centrifugal spinning apparatus according to claim 3, wherein the spinner device further comprises a height adjustment device for adjusting a distance between the spinneret and the collection device.

11. The centrifugal spinning apparatus according to claim 10, wherein the height adjustment device comprises a support plate for fixedly mounting the spinneret, a guide rod connected to the support plate, a substrate mounted on the transverse strut, an adjusting plate connected to an other end of the guide rod, and an adjusting screw rod mounted on the adjusting plate by a bearing seat, wherein a nut is disposed on the adjusting plate, the adjusting plate is disposed above the substrate, and the adjusting screw rod and the nut are engaged to adjust a distance between the adjusting plate and the substrate, to adjust a distance between the support plate and the collection device.

12. The centrifugal spinning apparatus according to claim 11, wherein the height adjustment device further comprises a linear bearing fixedly mounted on the substrate, the linear bearing being sleeved around a periphery of the guide rod.

13. The centrifugal spinning apparatus according to claim 3, wherein the feeding device comprises a storage tank containing the spinning solution inside and a flow pump in communication with the storage tank, the flow pump being connected to a plurality of the buffer tanks through pipelines;

an electric switch valve and a flow meter are disposed on the pipeline between the flow pump and the buffer tank;

a liquid-level meter is disposed in both the storage tank and the buffer tank;

a stirrer is mounted in the storage tank.

14. The centrifugal spinning apparatus according to claim 1, wherein the collection device comprises a transmission traction device, a collection belt, and a horizontal support plate disposed below the collection belt and configured to support the collection belt, wherein the collection belt is an annular belt, and the transmission traction device drives the collection belt to perform circular movement;

the collection belt is provided with a plurality of ventilation holes, and the horizontal support plate is provided with a plurality of through holes;

the collection device further comprises an air draft device disposed below the horizontal support plate and configured to form a negative pressure on a surface of the collection belt, to absorb the centrifugal spinning fibers onto the collection belt.

15. The centrifugal spinning apparatus according to claim 14, the plane receiving-type centrifugal spinning apparatus further comprises an isolation cover plate annularly disposed around a periphery of the spinning device, the isolation cover plate and the collection belt forming a semi-closed cavity for accommodating the spinning device; and a temperature control device for controlling the temperature of the semi-closed cavity is disposed in the semi-closed cavity;

the temperature control device comprises a plurality of electric heating pipes and a plurality of refrigeration devices.

16. The centrifugal spinning apparatus according to claim 1, wherein the centrifugal spinning apparatus further comprises a control system, the control system being in signal connection to the spinning device, the feeding device, and the collection device.

17. A planar receiving-type centrifugal spinning automatic production device, comprising a centrifugal spinning apparatus for preparing a centrifugal spinning fiber web, a winding device for winding the centrifugal spinning fiber web into a roll, and a compaction device disposed between the centrifugal spinning apparatus and the winding device and configured to compact the centrifugal spinning fiber web, the centrifugal spinning apparatus being the centrifugal spinning apparatus according to claim 1.

18. The planar receiving-type centrifugal spinning automatic production device according to claim 17, wherein the compaction device comprises a compaction frame, a press roller mounted on the compaction frame, a rotation roller, and a press roller mounting plate for fixedly mounting the press roller; sliders are disposed at two ends of the press roller mounting plate, and slide rails for the sliders to slide are disposed on the compaction frame; and the compaction device further comprises an air cylinder disposed above the press roller mounting plate, a floating joint is mounted on a piston rod of the air cylinder, and an end of the floating joint abuts against the press roller mounting plate, to drive the press roller to slide along the slide rail through stretch-out and draw-back of the piston rod.

19. The planar receiving-type centrifugal spinning automatic production device according to claim 18, wherein the compaction device further comprises a driving portion for driving the rotation roller to rotate; the driving portion comprises a driving motor having an output shaft, a compaction driving sprocket mounted on the output shaft, a compaction driven sprocket mounted on the output shaft, and a compaction chain in transmission connection with the compaction driving sprocket and the compaction driven sprocket; and the driving motor drives the compaction driving sprocket to drive the compaction driven sprocket to rotate, to drive the rotation roller to rotate.

20. The planar receiving-type centrifugal spinning automatic production device according to claim 17, wherein the winding device comprises an upper winding frame, and a first guide roller, a limit roller, a tension adjusting roller, a second guide roller, and a winding roller that are sequentially disposed on the upper winding frame in a movement direction of the centrifugal spinning fiber web, the centrifugal spinning fiber web being guided into the winding device by the first guide roller and being wound on the winding roller after being guided by the tension adjusting roller and the second guide roller.

21. The planar receiving-type centrifugal spinning automatic production device according to claim 20, wherein guide blocks are disposed at two sides of the upper winding frame; and the guide blocks are provided with grooves for accommodating end portions of the tension adjusting roller, the tension adjusting roller is pressed on the centrifugal spinning fiber web, and adjusts a tension force of the centrifugal spinning fiber web by sliding in the groove.

22. The planar receiving-type centrifugal spinning automatic production device according to claim 20, wherein the winding device further comprises a deviation correcting device, and the deviation correcting device comprises a lower winding frame, a linear servo motor, a connecting seat connecting an output shaft of the linear servo motor and the upper winding frame, a deviation correcting slide rail mounted on the lower winding frame, and a deviation correcting slider mounted on the upper winding frame, the linear servo motor adjusting a position of the upper winding frame by driving the deviation correcting slider to slide along the deviation correcting slide rail.

23. The planar receiving-type centrifugal spinning automatic production device according to claim 17, wherein the plane receiving-type automatic centrifugal spinning production apparatus further comprises an unwinding device having a base fabric, the base fabric being threaded from the unwinding device into The centrifugal spinning apparatus, being tiled on the collection belt, and an end portion thereof being wound on the winding roller of the winding device.

24. The planar receiving-type centrifugal spinning automatic production device according to claim 23, wherein the unwinding device comprises an unwinding frame, and an unwinding roller, a second guide roller, a third guide roller, and a first guide roller that are sequentially mounted on the unwinding frame in a movement direction of the base fabric;

the unwinding roller is an inflatable shaft.

* * * * *